US006509700B2

(12) United States Patent
Nakatsuka et al.

(10) Patent No.: US 6,509,700 B2
(45) Date of Patent: Jan. 21, 2003

(54) APPARATUS AND METHOD FOR DRIVING A CATHODE DISCHARGE TUBE

(75) Inventors: Hiroshi Nakatsuka, Osaka (JP); Takeshi Yamaguchi, Kanagawa (JP); Katsu Takeda, Osaka (JP); Katsunori Moritoki, Osaka (JP); Kojiro Okuyama, Nara (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/987,869

(22) Filed: Nov. 16, 2001

(65) Prior Publication Data

US 2002/0070674 A1 Jun. 13, 2002

(30) Foreign Application Priority Data

Nov. 22, 2000 (JP) ..... 2000-356154

(51) Int. Cl.[7] ..... G05F 1/00

(52) U.S. Cl. ..... 315/291; 315/209 PZ; 315/DIG. 5; 310/318; 310/319; 310/316.03

(58) Field of Search ..... 315/209 PZ, 291, 315/224, 282, 360, DIG. 5, DIG. 7; 310/317, 318, 319, 316.01, 316.03, 359, 366

(56) References Cited

U.S. PATENT DOCUMENTS

| | | | | | |
|---|---|---|---|---|---|
| 5,705,879 | A | * | 1/1998 | Abe et al. | 310/316.01 |
| 5,751,092 | A | * | 5/1998 | Abe | 310/316.01 |
| 6,044,003 | A | * | 3/2000 | Toshinari et al. | 310/318 |
| 6,133,672 | A | * | 10/2000 | Sasaki et al. | 310/318 |
| 6,268,681 | B1 | * | 7/2001 | Yamaguchi et al. | 310/316.01 |
| 6,348,755 | B1 | * | 2/2002 | Shimamura et al. | 310/318 |

FOREIGN PATENT DOCUMENTS

| | | |
|---|---|---|
| JP | 8-31588 | 2/1996 |

* cited by examiner

*Primary Examiner*—Haissa Philogene
(74) *Attorney, Agent, or Firm*—Greenblum & Bernstein, P.L.C.

(57) ABSTRACT

The invention provides an apparatus and a method for driving a cathode discharge tube such that the discharge starting voltage can be lowered by simple construction. At the start of lighting a cathode discharge tube light, AC voltage applied to the cathode discharge tube is raised at a speed slower than a rise speed of the cathode discharge tube. By lighting the cathode discharge tube in this way, the lighting start voltage can be reduced.

41 Claims, 16 Drawing Sheets

TUBE VOLTAGE
LIGHTING START VOLTAGE
Vb
Vc
Va
Vo
0
0
LIGHTING OF COLD CATHODE TUBE
NEGATIVE RESISTANCE REGION
TIME

TUBE CURRENT
SETTING CURRENT
0
0
NEGATIVE RESISTANCE REGION
START OF LIGHTING COLD CATHODE DISCHARGE TUBE
TIME

TUBE VOLTAGE
LIGHTING START VOLTAGE
Vs
0
0
LIGHTING OF COLD CATHODE TUBE
NEGATIVE RESISTANCE REGION
TIME

TUBE CURRENT
SETTING CURRENT
0
0
NEGATIVE RESISTANCE REGION
START OF LIGHTING COLD CATHODE DISCHARGE TUBE
TIME

BEFORE THE START OF DISCHARGE
(Va)
STEP-UP RATIO
fdrive
FREQUENCY

AT TOWNSEND DISCHARGE FREQUENCY
(Vb)
STEP-UP RATIO
fdrive
FREQUENCY

AT THE LIGHTING OF COLD CATHODE TUBE
(Vc)
STEP-UP RATIO
fdrive
FREQUENCY

TUBE VOLTAGE
LIGHTING START VOLTAGE
Vb
Vc
Va
Vo
0
0
LIGHTING OF COLD CATHODE TUBE
NEGATIVE RESISTANCE REGION
TIME

APPARATUS AND METHOD FOR DRIVING A CATHODE DISCHARGE TUBE

BACKGROUND OF THE INVENTION

1. Field of the Invention

The present invention relates to a device and a method for driving a cathode discharge tube that is used as a light source for a liquid crystal display, display panel and the like.

2. Description of the Related Art

In recent years, for back-lights in liquid crystal displays of notebook computers and the like, there have been used cold cathode fluorescent tubes and hot cathode fluorescent tubes, which consume a comparatively small amount of electric power and have high luminous efficacy.

So far, in a cathode discharge lighting device that lights these cathode discharge tubes, a DC voltage is converted into an AC voltage by a DC/AC inverter circuit, and then using the AC voltage the cold or hot cathode discharge tube is lighted. The discharge starting voltage for a cold cathode discharge tube is higher than that for a hot cathode discharge tube. Also, the discharge starting voltage becomes higher, as the length of a cold cathode discharge tube becomes greater.

FIG. 16 shows prior circuitry of a cold cathode discharge device that lights a cold cathode discharge tube. As shown by FIG. 16, the cold cathode discharge device has an inverter circuit 311. The inverter circuit 311 comprises switching elements 304*a* and 304*b* such as transistors and a step-up transformer 302 that transforms the input voltage into a high voltage. An AC voltage is generated from a DC voltage output from a DC power supply 307 by alternately switching the switching elements 304*a* and 304*b*. This AC voltage is transformed to a higher voltage by the step-up transformer 302 and supplied to a cold cathode discharge tube 210.

The operation at the start of lighting is described with reference to FIG. 17. FIG. 17A shows the envelope of the voltage (tube voltage) across the cold cathode discharge tube 210, while FIG. 17B shows the envelope of the current (tube current) flowing through the cold cathode discharge tube 210. In order to light the cold cathode discharge tube 210, a high AC voltage generated on the secondary side of the step-up transformer 302 is applied to the cold cathode discharge tube 210. At this time, before the cold cathode discharge tube 210 is lighted, the voltage across the cold cathode discharge tube 210 rises (see FIG. 17A), but current does not flow because there is almost no load (FIG. 17B). After that, when the voltage across the cold cathode discharge tube 210 further rises and reaches the lighting start voltage, the current suddenly starts to flow while the voltage starts to fall. Subsequently the cold cathode discharge tube 210 has negative resistance, so that the tube voltage falls, and the tube current rises to become a setting current (a predetermined current necessary to maintain the lighting). In the case of cold cathode discharge tube 210, in order to limit the pouring current, a current control element 301 such as a capacitor is connected in serial to cold cathode discharge tube 210. In short, at the start of lighting cold cathode discharge tube 210, an applied voltage higher than the voltage necessary for maintaining the lighting is required by a large margin. Further, the lighting maintenance voltage and lighting start voltage tend to become higher as cold cathode discharge tube 210 becomes longer.

In general, as a method of lowering this discharge starting voltage in a cathode discharge device, there is a method of lowering the discharge starting voltage by grounding a near-by conductor at the perimeter of the cold cathode discharge tube (or a hot cathode discharge tube).

In the method of grounding a nearby-conductor at the perimeter of a cathode discharge tube to lower the discharge starting voltage, a potential difference occurs between the electrode to which a high voltage is input and the near-by conductor, so that an effect of lowering the discharge starting voltage is obtained by a discharge prompting effect. However, in a cathode discharge lighting device, the other cathode and the near-by conductor are both grounded, so that there occurs no potential difference between them. Therefore, in the discharge device shown as a prior art, glow discharge starting from Townsend discharge reaches whole-tube discharge from the high-voltage electrode toward the GND electrode of the cathode discharge tube. In this way, in the prior discharge device, the discharge prompting effect is obtained only at the high-voltage electrode and not at the other electrode, so that the effect is not sufficient for a method of lowering the discharge starting voltage.

Further, as a method for solving the above problem, there is a method disclosed in the Japanese Laid-open Patent Publication No. 8-31588. In the method proposed by the Publication No. 8-31588, a near-by conductor is connected to the middle potential point of the high AC voltage to make the potential of the nearby conductor the middle potential, and thus Townsend discharge is induced from both electrodes to lower the discharge starting voltage. However, in this method, the sustaining voltage for lighting becomes higher as the cold cathode discharge tube becomes longer, so that a leak current is generated by a floating capacity between the nearby conductor and the cold cathode discharge tube. As a result, there are such problems as the lowering of luminance and the enlarging of the discharge device due to reactive power. Also, there is another problem that it is difficult to detect a current flowing through the discharge tube.

SUMMARY OF THE INVENTION

The present invention is made to solve the above problems. The object of the present invention is thus to provide a device and a method for lighting a cold cathode discharge tube which can lower the discharge starting voltage by a simple method without degrading the characteristics of the lighting device for a cathode discharge tube even if the cathode discharge tube becomes longer.

In a first aspect of the invention, an apparatus for driving a cathode discharge tube by applying an AC voltage to the cathode discharge tube is provided. The apparatus comprises a voltage application section which outputs an AC voltage to be applied to the cathode discharge tube, and a voltage controller which controls the output of the voltage application section. In order to light the cathode discharge tube, the voltage controller controls the output of the voltage application section so that the AC voltage applied to the cathode discharge tube is raised at a speed slower than a rise speed of the cathode discharge tube.

In a second aspect of the invention, a driving apparatus for driving a cathode discharge tube by applying an AC voltage to the cathode discharge tube is provided. The apparatus comprises a voltage application section which outputs an AC voltage to be applied to the cathode discharge tube, and a voltage controller which controls the output of the voltage application section. In order to light the cathode discharge tube, the voltage controller controls the output of the voltage application section so that the cathode discharge tube is half-lighted by the AC voltage, and subsequently the AC voltage is raised at a speed slower than a rise speed of the cathode discharge tube.

In a third aspect of the invention, a driving apparatus for driving a cathode discharge tube by applying an AC voltage to the cathode discharge tube is provided. The apparatus comprises a voltage application section which outputs an AC voltage to be applied to the cathode discharge tube, and a voltage controller which controls the output of the voltage application section. In order to light the cathode discharge tube, the voltage controller controls the output of the voltage application section so that the cathode discharge tube is half-lighted by the AC voltage, the state of half-lighting is maintained for a predetermined period, and then the AC voltage is raised to a voltage level at which the cathode discharge tube starts discharging.

In the above driving apparatus, the voltage controller may vary the AC voltage stepwise during the sate of half-lighting. Also, in the case where adjustment of light is performed at the time of starting to light the cathode discharge tube by repeating lighting and putting-out, the voltage controller may make the lighting time during the light adjustment shorter than the first lighting time at the start of the lighting.

In a fourth aspect of the invention, a method of driving a cathode discharge tube by applying an AC voltage to the cathode discharge tube is provided. The method comprises outputting an AC voltage to be applied to the cathode discharge tube, and controlling the output AC voltage. The controlling includes controlling the output AC voltage so that the AC voltage applied to the cathode discharge tube rises at a speed slower than a rise speed of the cathode discharge tube, in order to light the cathode discharge tube.

In a fifth aspect of the invention, a method of driving a cathode discharge tube by applying an AC voltage to the cathode discharge tube is provided. The method comprises outputting an AC voltage to be applied to the cathode discharge tube, and controlling the output AC voltage. The controlling includes controlling the output AC voltage so that the cathode discharge tube is half-lighted by the AC voltage, and subsequently the AC voltage rises at a speed slower than a rise speed of the cathode discharge tube.

In a sixth aspect of the invention, a method of driving a cathode discharge tube by applying an AC voltage to the cathode discharge tube is provided. The method comprises outputting an AC voltage to be applied to the cathode discharge tube, and controlling the output AC voltage. In order to light the cathode discharge tube, the controlling includes controlling the output AC voltage so that the cathode discharge tube is half-lighted by the AC voltage, the state of half-lighting is maintained for a predetermined period, and then the AC voltage rises to a voltage level at which the cathode discharge tube starts discharging.

In a seventh aspect of the invention, a driving apparatus for driving a cathode discharge tube by applying an AC voltage to the cathode discharge tube is provided.

The apparatus comprises a voltage application section that outputs an AC voltage to be applied to the cathode discharge tube, and a voltage controller that controls the output of the voltage application section. In order to light the cathode discharge tube, the voltage controller controls the output of the voltage application section so that the AC voltage applied to the cathode discharge tube is raised slowly and thereby a protrusion in voltage change does not appear at a moment of lighting of the cathode discharge tube.

BRIEF DESCRIPTION OF THE DRAWINGS

Other objects and attainments together with a fuller understanding of the invention will become apparent and appreciated by referring to the following description and claims taken in conjunction with the accompanying drawings, in which like parts are designated by like reference numerals and in which:

DESCRIPTION OF THE PREFERRED EMBODIMENTS

Driving devices and methods for cathode discharges tubes in accordance with the present invention are detailed in the following with reference to a attached drawings.

First Embodiment

Figure 1:
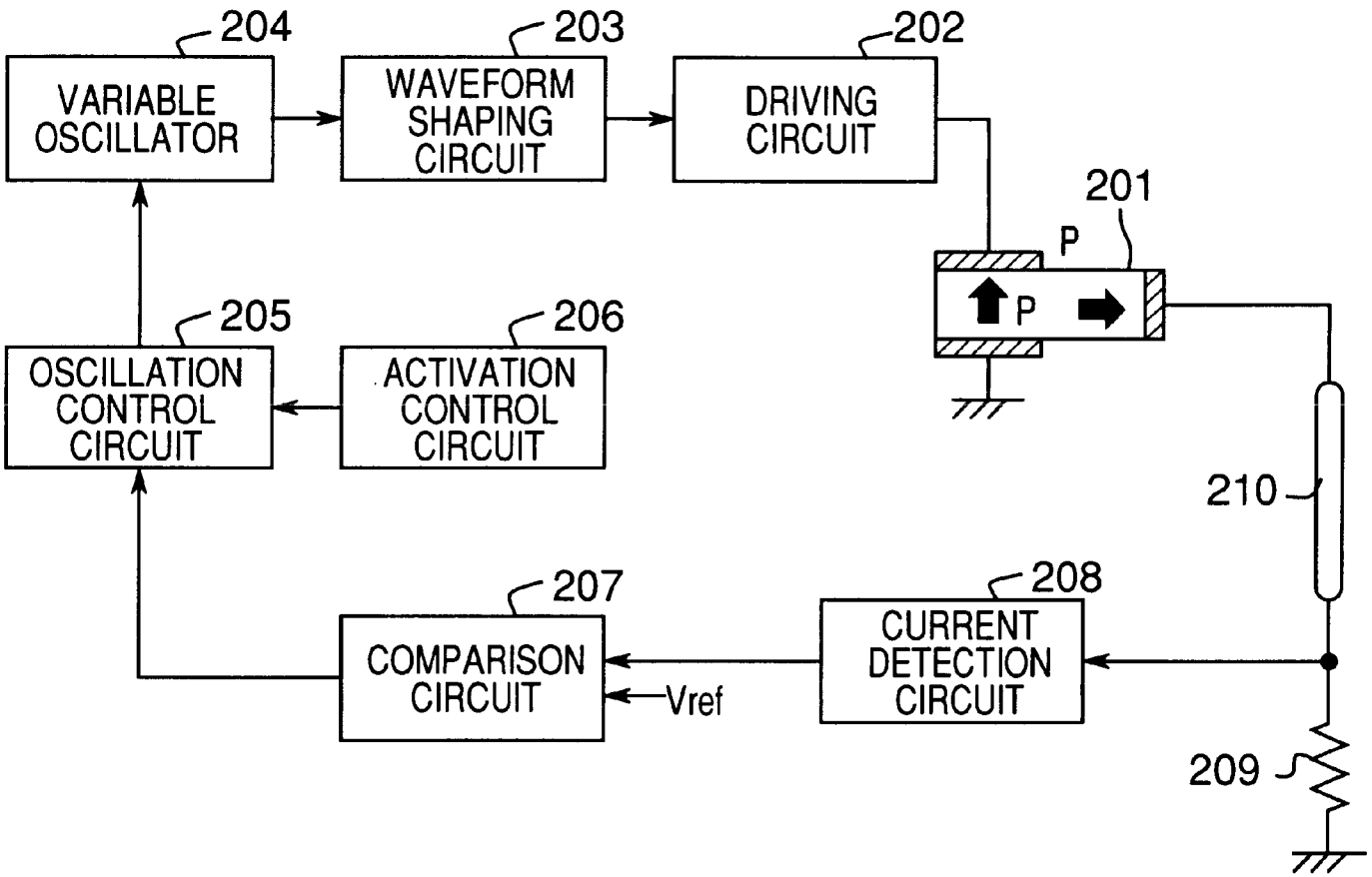
FIG. 1 is a block diagram of a driving device for a cold discharge tube in accordance with the first embodiment of the present invention.

FIG. 1 is a block diagram of a first embodiment of a driving device for a cold discharge tube in accordance with the present invention. As shown in FIG. 1, the driving device (hereafter called "driving device") for a cold cathode discharge tube comprises a piezoelectric transformer 201 that supplies a desired AC power to a cold cathode discharge tube 210.

Figure 2:
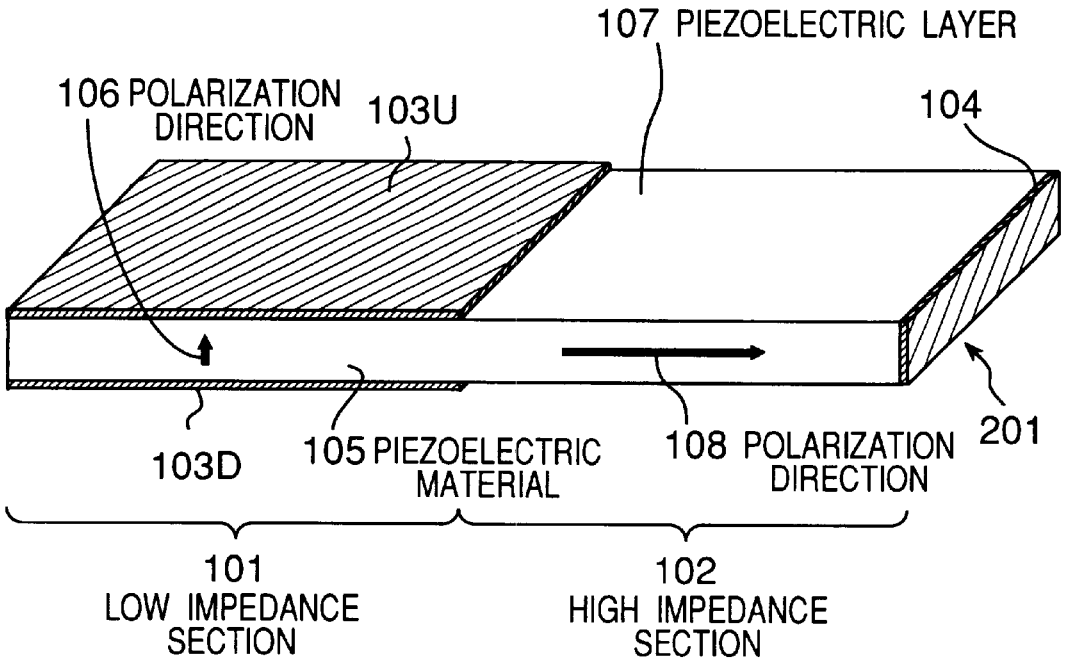
FIG. 2 is a configuration diagram of a piezoelectric transformer used in the driving device for a cold cathode discharge tube.

The piezoelectric transformer 201 is a Rosen-type piezoelectric transformer and has a configuration as shown in FIG. 2. The piezoelectric transformer 201 comprises a low impedance section 101 and a high impedance section 102. The low impedance section 101 becomes an input section when the piezoelectric transformer 201 is used as a voltage booster. Piezoelectric material 105 of the low-impedance section 101 is polarized in a thick direction, and electrodes 103U and 103D are provided on principal surfaces in the thick direction. On the other hand, the high impedance section 102 becomes an output section when the piezoelectric transformer 201 is used as a voltage booster.

Piezoelectric material 108 of the high impedance section 102 is polarized in a longitudinal direction, and an electrode 104 is provided on its end face.

In the piezoelectric transformer 201, when a voltage matched with a resonance frequency of mechanical vibrations on the output side is applied to electrodes 103U and 103D of input section 101, electric energy is converted into mechanical energy by the (inverse-) piezoelectric effect, and longitudinal vibrations in the longitudinal direction are driven. In the output section 102, mechanical energy is converted into electric energy by the piezoelectric effect to generate a voltage. Since the polarization direction in the output section 102 is longitudinal and the length of high impedance section 102 is greater than its thickness, higher voltage can be easily obtained from the electrode 104.

Figure 3:
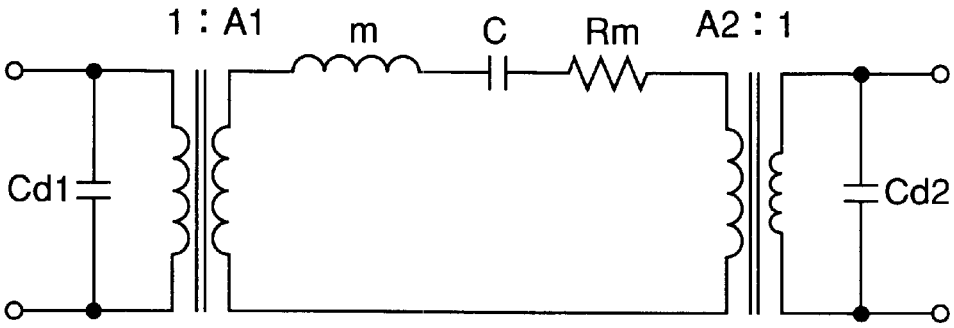
FIG. 3 is an equivalent circuit diagram near the resonance frequency for a piezoelectric transformer.

FIG. 3 is a circuit diagram showing a lumped-parameter equivalent circuit at a neighborhood of the resonance frequency for a piezoelectric transformer. As shown in FIG. 3, the equivalent circuit for a piezoelectric transformer is represented by bound capacitors Cd1 and Cd2 on the input and output sides, a force factor Al on the input side, a force factor A2 on the output side, equivalent mass m, equivalent compliance C, and an equivalent mechanical resistance Rm. In a piezoelectric transformer of the present embodiment, the force factor A1 is greater than the force factor A2, and the two ideal transformers in FIG. 3 boost or step up a voltage. Further, the piezoelectric transformer contains a serial oscillator comprising equivalent mass m and equivalent compliance C, and therefore the output voltage becomes greater than that determined by the transformation ratio of the transformer if the load resistance is great.

Turning to FIG. 1, the construction of the driving device for a cold cathode discharge tube is described in details. The driving device for a cold cathode discharge tube comprises a driving circuit 202, a waveform shaping circuit 203, a variable oscillator 204, an oscillation control circuit 205, an activation control circuit 206, a comparison circuit 207, a current detection circuit 208, and a feedback resistor 209, besides the piezoelectric transformer 201.

The variable oscillator 204 generates an AC activating signal that drives the piezoelectric transformer 201. The output of the variable oscillator 204 is input to the waveform shaping circuit 203. The waveform shaping circuit 203 reduces components of piezoelectric transformer 201 other than that of the driving frequency and feeds a desired AC signal to the driving circuit 202. The output of the waveform shaping circuit 203 is amplified to a voltage level sufficient to the drive piezoelectric transformer 201 and input to the electrodes on the primary side of piezoelectric transformer 201. The output voltage stepped-up by the piezoelectric effect of the piezoelectric transformer 201 is tapped from the electrode on the secondary side of the piezoelectric transformer 201.

The high voltage output from the secondary side electrode of the piezoelectric transformer 201 is applied to a serial circuit comprising the cold cathode discharge tube 210 and the feedback resistor 209. The voltage generated between the two ends of the feedback resistor 209 is input to the current detection circuit 208, which detects the current flowing through the cold cathode discharge tube 210 as a voltage value and outputs a DC detection signal to the comparison circuit 207. The comparison circuit 207 compares the output voltage of the current detection circuit 208 with a predetermined setting voltage Vref. The setting voltage Vref sets a desired value of the output voltage of the current detection circuit 208, and the tube current (or luminance) is made constant by controlling the output voltage of the current detection circuit 208. If the output voltage of the current detection circuit 208 is less than the setting voltage Vref based on the comparison result (that is, the tube current is less than a setting value), then a control signal is sent to the oscillation control circuit 205 such that the driving frequency approaches the resonance frequency. If the output voltage of the current detection circuit 208 is greater than the setting voltage Vref (that is, the tube current is greater than a setting value), then a control signal is sent to the oscillation control circuit 205 such that the driving frequency departs from the resonance frequency.

The oscillation control circuit 205 controls the variable oscillator 204 in order to control the driving frequency of the piezoelectric transformer 201 according to the output of the comparison circuit 207.

Further, the activation control circuit 206 outputs a control signal to the oscillation control circuit 205 until the cold cathode discharge tube 210 is lighted. The activation control circuit 206 operates to output a control signal to the oscillation control circuit 205 that controls the driving frequency of piezoelectric transformer 201 until the cold cathode discharge tube 210 is lighted. Until the cold cathode discharge tube 210 is lighted, the operation of the comparison circuit 207 is halted. When the cold cathode discharge tube 210 is lighted, the operation of the activation control circuit 206 is stopped, and the operation of the oscillation control circuit 205 is controlled by the output signal of the comparison circuit 207.

In order to light the cold cathode discharge tube 210, the driving device constructed as described above slowly raises the voltage applied to the cold cathode discharge tube 210 so that the time constant of rising in the applied voltage becomes greater than the time constant of rising of the cold cathode discharge tube 210. That is, the applied voltage for cold cathode discharge tube 210 is raised so that the rise speed of the applied voltage is made slower than the rise speed of cold cathode discharge tube 210. By this means, the lighting voltage for the cathode discharge tube is lowered from a prior voltage value.

Figure 15:
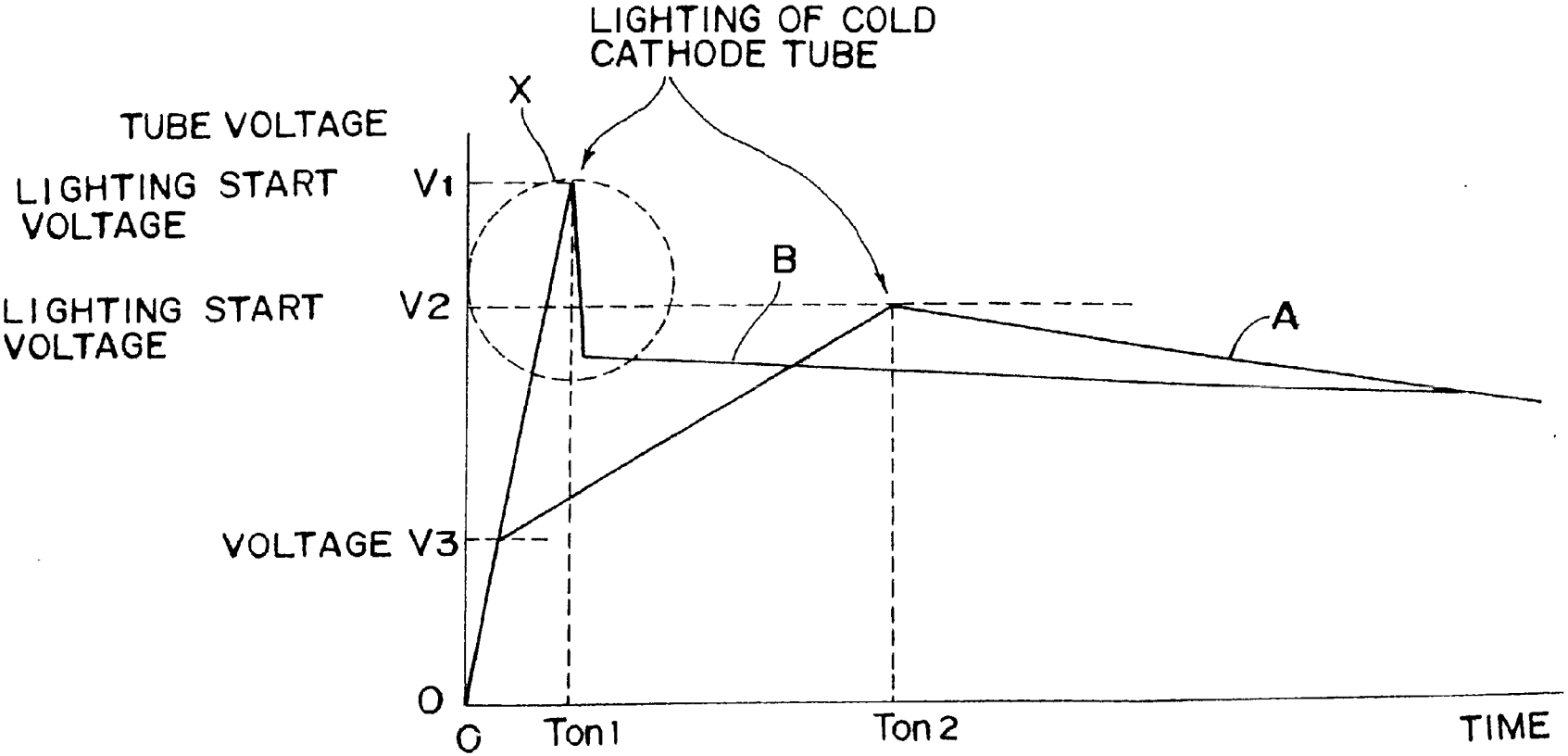
FIG. 15 is a drawing for illustrating a driving device for a cold cathode discharge tube in accordance with the present invention.
Figure 16:
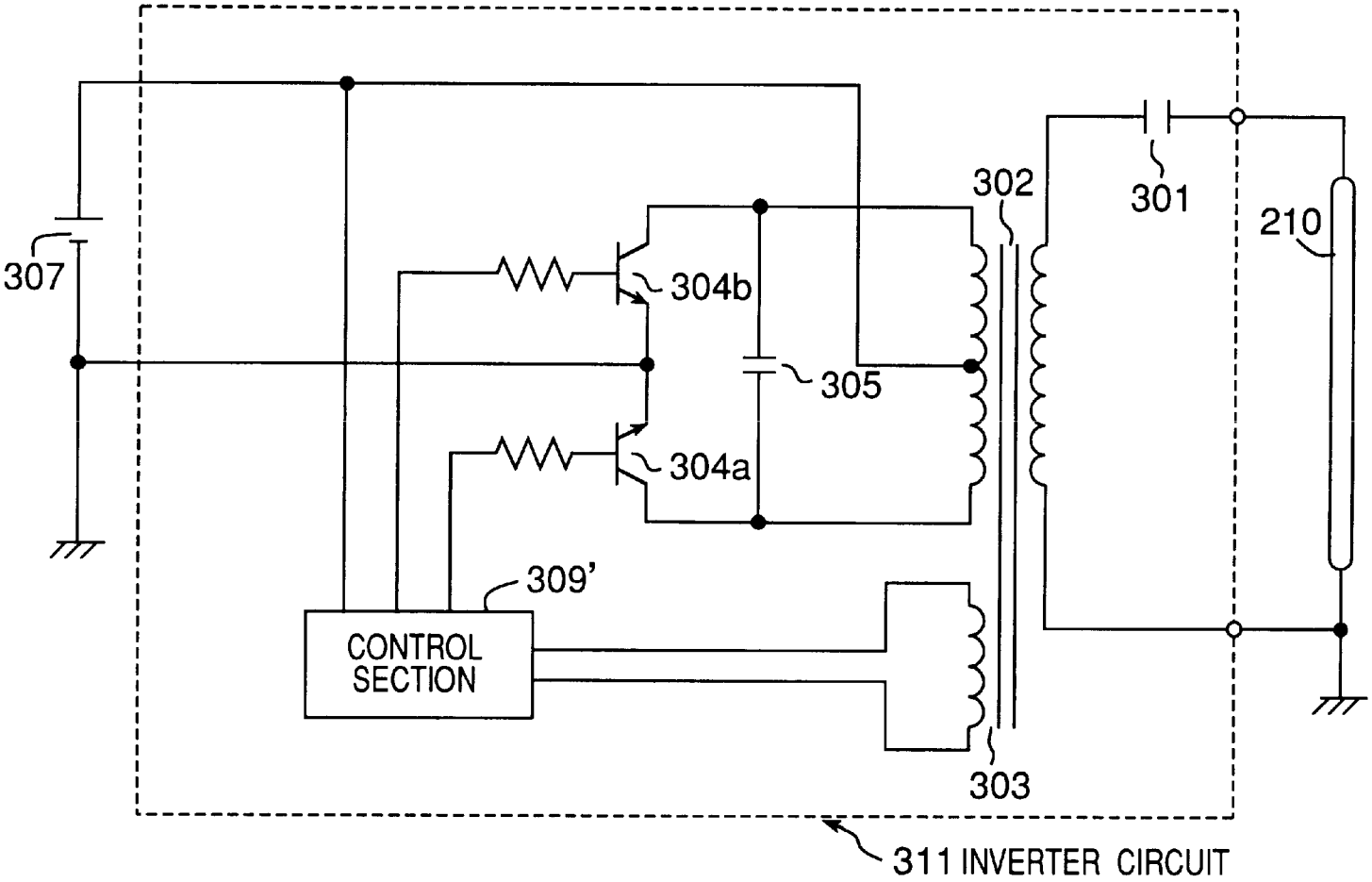
Fig.16 PRIOR ART
FIG. 16 is a block diagram of a prior driving device for a cold discharge tube.
Figures 17A, 17B:
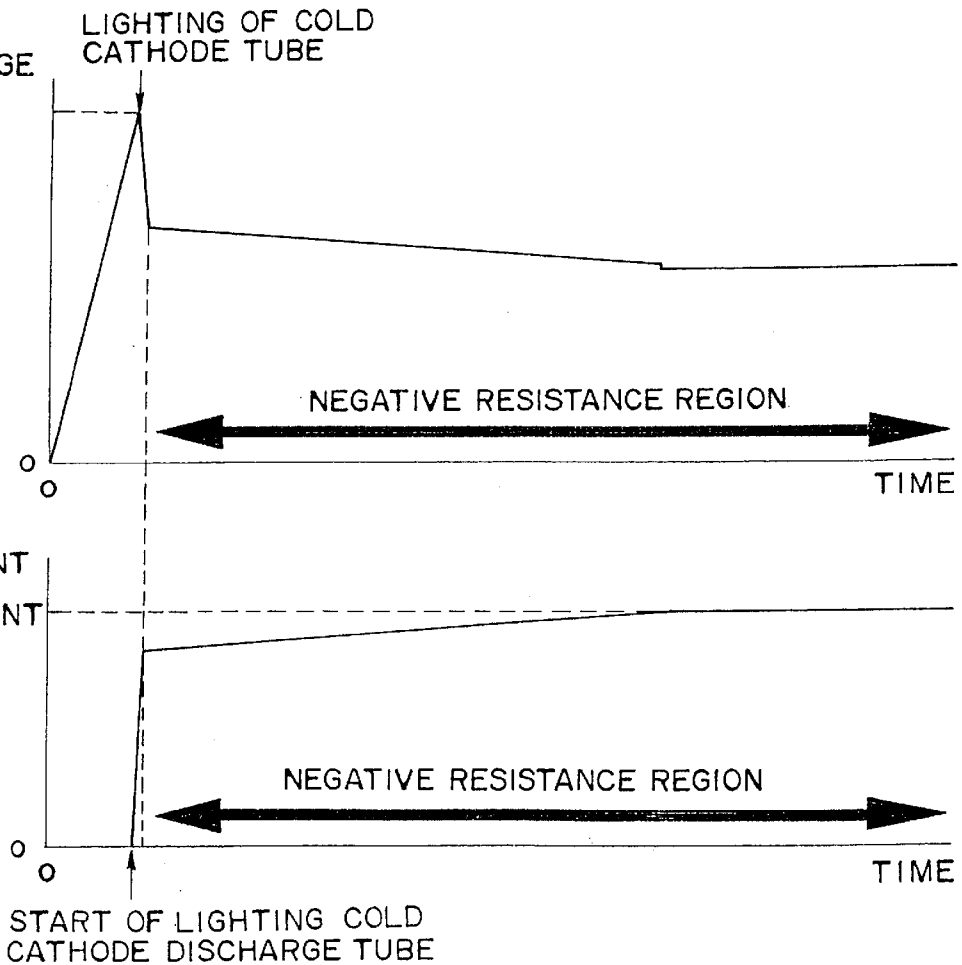
Fig. 17A PRIOR ART
Fig. 17B PRIOR ART
FIG. 17A is a graph showing temporal changes in a tube voltage in the case where a cold cathode discharge tube is driven by a prior driving device.
FIG. 17B is a graph showing temporal changes in a tube current in the case where a cold cathode discharge tube is driven by a prior driving device.

With reference to FIG. 15, the control of a driving device according to the present invention is described below. In FIG. 15, a lighting start voltage V1 is a voltage level at which a current starts to flow through electrodes of the cathode discharge tube when a voltage applied to the cathode discharge tube reaches a voltage level greater than or equal to a specific voltage level at which the cathode discharge tube starts to light while the applied voltage is increased at a high speed. A lighting start voltage V2 is a minimum voltage level which is necessary to light the same cathode discharge tube. In the case of a piezoelectric transformer, the amplitude of oscillation is gradually increased until the applied voltage actually reaches the lighting start voltage V1, and therefore the applied voltage does not reach the voltage V1 instantaneously (the same is true for electromagnetic transformers). Here, a rise of the cathode discharge tube is defined by an operation from when a voltage application is started, through when the applied voltage reaches the voltage V1 and the voltage declines, and to when the current is controlled to be constant. The passing time during such the operation is taken as a rise time (time constant). Therefore, the rise speed of the cold cathode discharge tube means a slope of the voltage change for the time period from a time when voltage application starts to a time (Ton1) when the cold cathode discharge tube starts to light up by applying a voltage greater than the lighting start voltage V2. The present embodiment decreases this rise time compared with the prior driving devices.

The curve B of FIG. 15 shows voltage changes in the case where the applied voltage is varied at a comparatively high speed. The curve A shows voltage changes in the case where the applied voltage is controlled to vary at comparatively slow speed so that the lighting start voltage can become the voltage V2. As illustrated in the figure, the lighting start voltage can be lowered by raising the applied voltage at a slower speed.

If the applied voltage is raised at a relatively high speed, the applied voltage rapidly falls down after it reaches the lighting start voltage V1, and then it changes gradually, as indicated by the curve B. That is, a projecting part X is seen in voltage changes. This projecting part appears in the case where large power is supplied to the cathode discharge tube at the instant when the cathode discharge tube is lighted. As shown in the curve A, when the lighting start voltage becomes high by a power supplied at a comparatively high speed, a large power is supplied to the cathode discharge tube at the instant when the cathode discharge tube is lighted, and thus the projecting part X appears. Changing voltage at a comparatively high speed means that the voltage is varied so that such a projecting part X should appear. The voltage appeared in that case is taken as V1.

In contrast, according to the present invention, the applied voltage is raised at a comparatively slow speed. That is, after the applied voltage reaches the lighting start voltage V2, the applied voltage is controlled so that it can gradually fall without showing a projecting part X. That is, the rise speed of the voltage rise is made sufficiently small. By controlling in this way, the lighting start voltage can be lowered, and the projecting part X in the curve A does not appear, since the power supplied at the instant when the cathode discharge tube is lighted becomes small. In summary, the present embodiment intends to lower the lighting start voltage by gradually varying the applied voltage so that the projecting part X should not appear.

As an actual example, a cold cathode tube with 400 mm long and 3.0 mm in diameter was driven. In a prior lighting method (Curve B, Ton1 is 0.1 ms), the lighting start voltage was 1600 Vrms. In the method of present embodiment (Curve A, Ton2 is 1 ms, i.e. 10 times the prior art), the lighting start voltage was 1250 Vrms. Therefore, the lighting start voltage was largely reduced.

In the following, the operation of a driving device that realizes such control of tube voltage is described in details.

Figure 4:
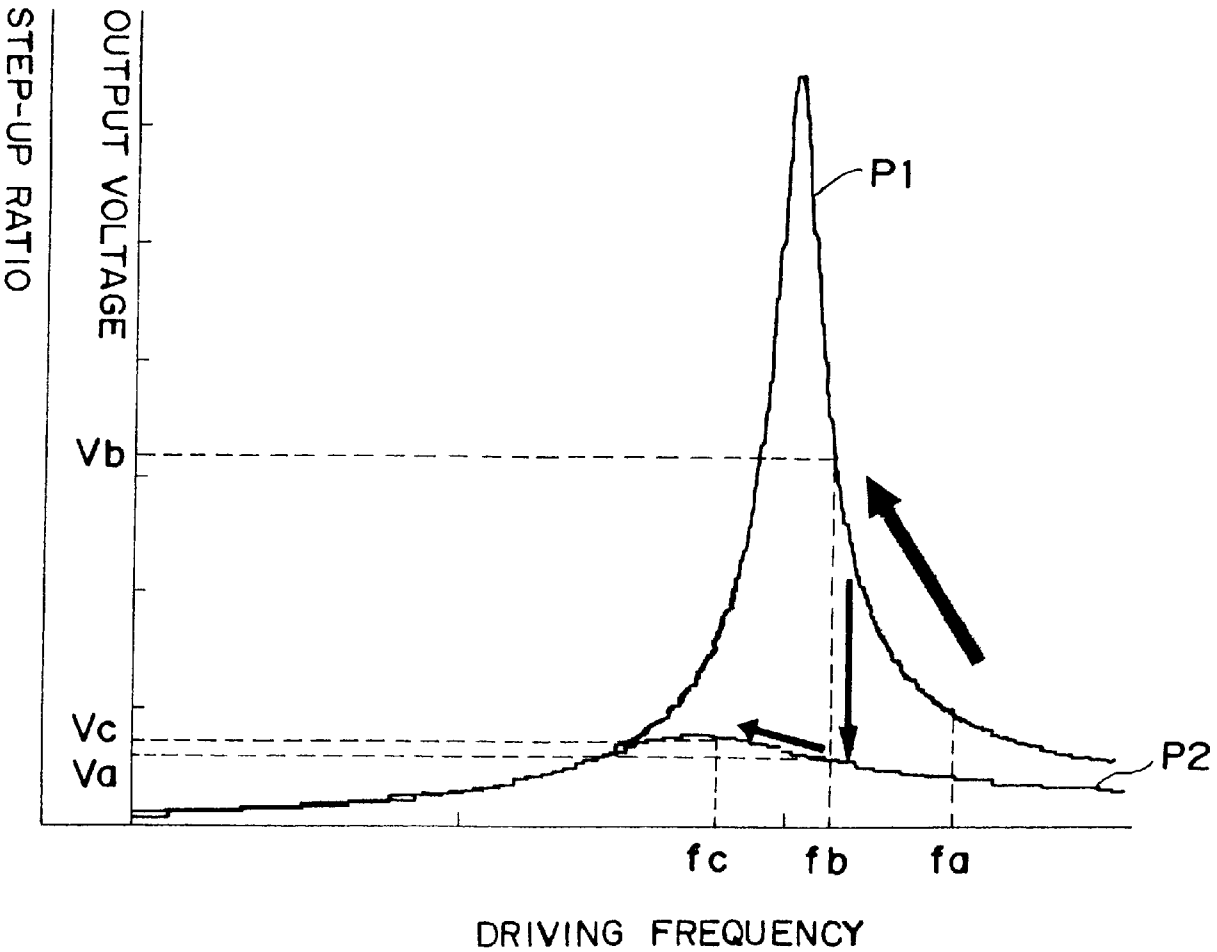
FIG. 4 is a graph showing the frequency characteristics of the step-up ratio due to changes in the load of a general piezoelectric transformer.
Figure 5:
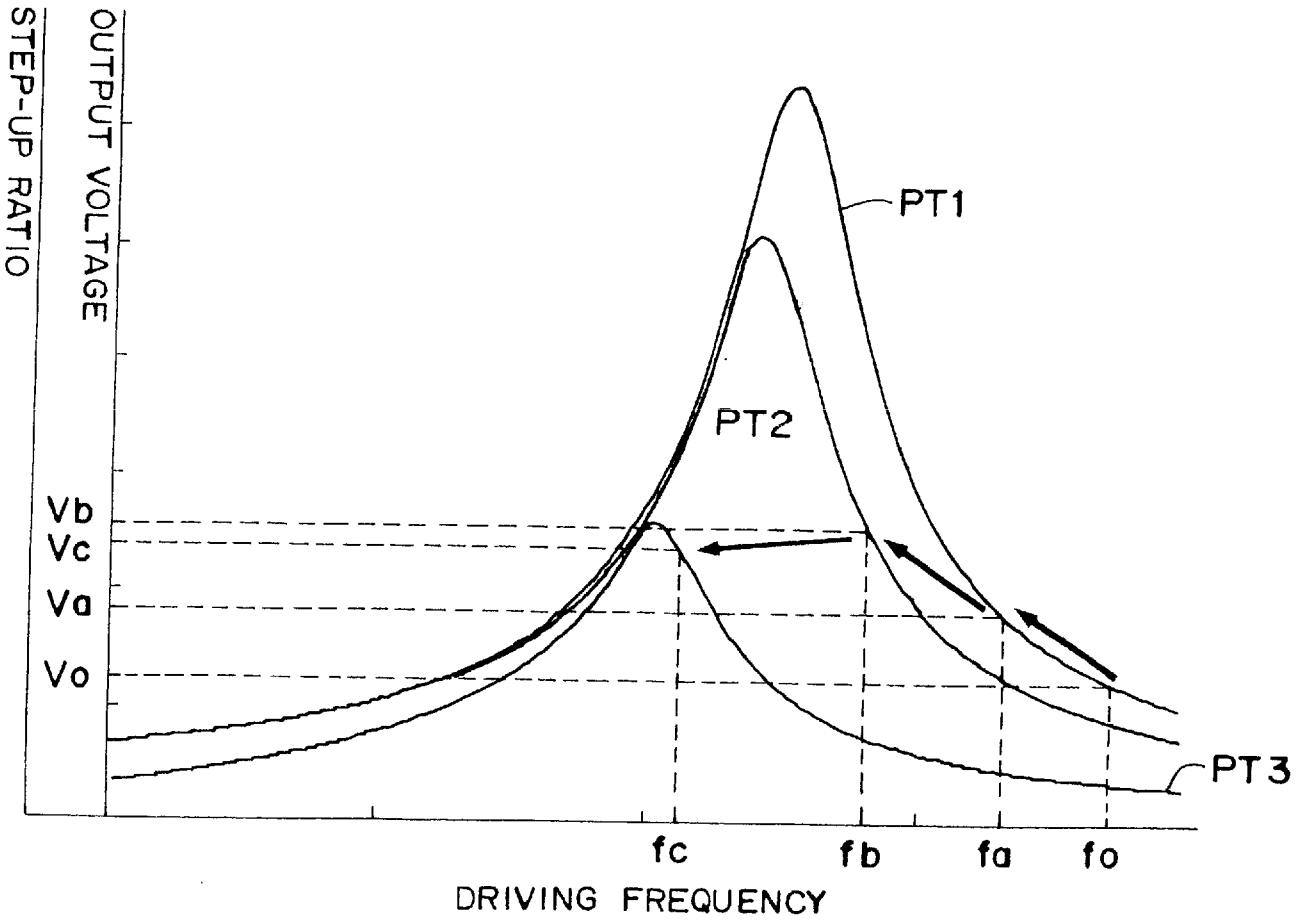
FIG. 5 is a graph showing the frequency characteristics of the step-up ratio corresponding to changes in the load of a piezoelectric transformer due to the driving method of the first embodiment.

FIG. 4 is a graph showing the frequency characteristics of the step-up ratio of a general piezoelectric transformer. The curve P1 in FIG. 4 shows changes in the step-up ratio before the lighting of the cold cathode tube, and the curve P2 shows the step-up ratio during the lighting of the cold cathode tube. The step-up ratio of the piezoelectric transformer 201 varies with the load and frequency. The present embodiment employs this property of a piezoelectric transformer, i.e. the property that the frequency characteristics of the piezoelectric transformer varies as the load of the piezoelectric transformer 201 changes. FIG. 5 shows changes in the step-up ratio of the piezoelectric transformer 201 in the present embodiment. In FIG. 5, the curve PT1 shows the step-up ratio before the lighting of the cold cathode discharge tube 210, the curve PT2 shows the step-up ratio during Townsend discharge, and the curve PT3 shows the step-up ratio during glow discharge (during lighting).

Figures 6A, 6B:
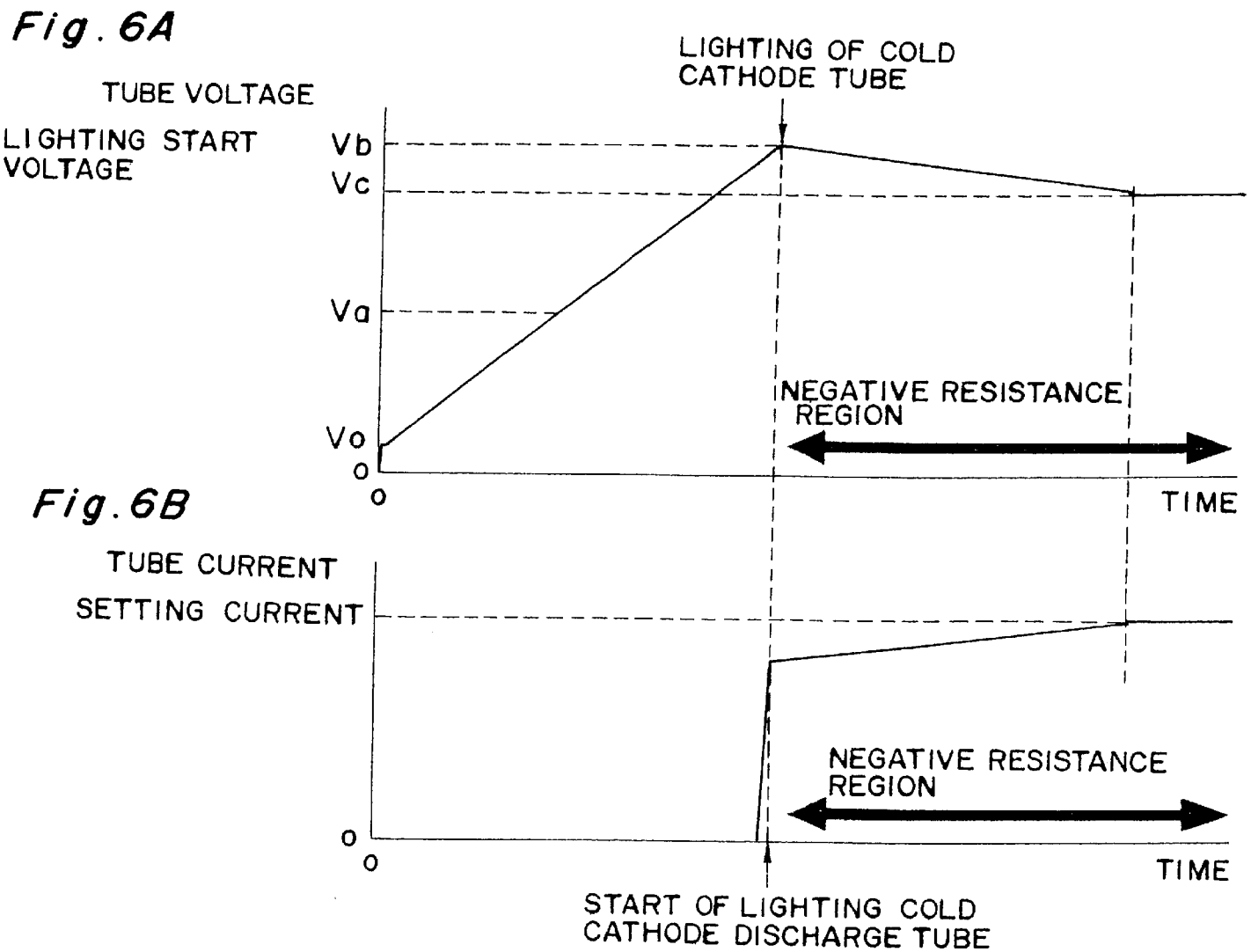
FIG. 6A is a graph showing temporal changes in a tube voltage in the case where a cold cathode discharge tube is driven by a driving device of the first embodiment.
FIG. 6B is a graph showing temporal changes in a tube current in the case where a cold cathode discharge tube is driven by a driving device of the first embodiment.

In a driving device of the present embodiment, to light the cold cathode discharge tube 210, the driving frequency of the piezoelectric transformer 201 is gradually swept from a frequency higher than the resonance frequency to a lower frequency during the time so that the driving frequency can approach the resonance frequency. FIG. 6A shows temporal changes in tube voltage in its envelope in the sweep in which the driving frequency approaches the resonance frequency. FIG. 6B shows temporal changes in tube current in its envelope during this time.

The lighting operation of a driving device of the present embodiment is described. First, by the activation circuit 206, the sweep of driving frequency of the piezoelectric transformer 201 is started from a predetermined frequency f0, as a start frequency, higher than the resonance frequency toward the resonance frequency.

As a result, a high voltage V0 corresponding to the step-up ratio of the curve PT1 is output from the secondary side electrode of the piezoelectric transformer 201. The driving frequency is sequentially shifted from the frequency f0 to a lower frequency. When it reaches a predetermined frequency fa, a voltage Va corresponding to the step-up ratio of the curve PT1 is output from the secondary side of the piezoelectric transformer, and the cold cathode discharge tube 210 starts Townsend discharge.

An equivalent circuit for the cold cathode discharge tube 210 can be represented by variable capacitance, until the lighting (glow discharge) of the cold cathode discharge tube 210 is started. Therefore, a voltage corresponding to the curve PT2 is output from the piezoelectric transformer 201 (in an actual situation, the load changes with the increase in the voltage, and therefore the step-up ratio curve is sequentially changes). At this time, only a very small amount of current is flowing through the feedback resistor 209, and the cold cathode discharge tube 210 becomes a state of half-lighting.

The driving frequency is further made closer to the resonance frequency. When the resonance frequency reaches a predetermined frequency fb, the output from the secondary side of the piezoelectric transformer 201 becomes the lighting start voltage Vb to light for the cold cathode discharge tube 210, and the cold cathode discharge tube 210 is lighted. Then a large amount of current starts to flow in the feedback resistor 209, the operation of the activation control circuit 206 stops, the oscillation control circuit 205 operates so as to make the tube voltage a predetermined value based on the output from the comparison circuit 207. When the cold cathode discharge tube 210 is in a state of lighting, an equivalent circuit for the cold cathode discharge tube 210 is represented by a parallel circuit comprising a resistor and a capacitor. The equivalent circuit shows a negative resistance characteristic where a voltage decreases as a current increases.

Since the cold cathode discharge tube 210 shows a negative resistance characteristic, the voltage across the cold cathode discharge tube 210 is going to decline as the output power of the secondary side of the piezoelectric transformer 201 becomes greater. And the current increases until it becomes a predetermined current, and the driving frequency and the tube voltage respectively become fc and Vc.

As a result of lighting the cold cathode discharge tube 210, the step-up ratio of the piezoelectric transformer 201 shows the characteristics represented by the curve PT2. The output power from the secondary side of the piezoelectric transformer becomes Vc, corresponding to the step-up ratio.

In the present embodiment, the lighting of the discharge tube at a low voltage has been performed by temporarily and continuously increasing the voltage (tube voltage) across the cold cathode discharge tube 210 from a low level. However, the tube voltage can be increased stepwise, as shown in FIG. 1. Specifically, the tube voltage can be linearly increased to a predetermined level Vs below the lighting start voltage Vb, maintained at that level for a predetermined period, and increased again linearly. Similar effects can be obtained by this method. In this case, the voltage level first applied should be within a range in which Townsend discharge occurs and does not change into glow discharge. Further, there is an effect that the time until the lighting is started can be shortened.

Further, as shown in FIGS. 4 and 5, the frequency characteristics of the step-up ratio of a piezoelectric transformer steeply change near the resonance frequency before the cold cathode discharge tube discharges. Therefore, as the frequency approaches the resonance frequency, the speed of sweeping the frequency can be lowered so that the ratio of voltage changes should be approximately constant. By this means, the danger of excessive voltage due to a delay in the lighting of the cold cathode discharge tube can be prevented.

Regarding a control of adjusting light for the cold cathode discharge tube, when the light is adjusted by a repeat of lighting and extinguishing, the lighting time for the second and later lighting can be shorter than lighting time for the first lighting. In the case of the light adjustment by lighting and extinguishing the cold cathode discharge tube, the dispersion of luminance during driving and a delay in lighting can be prevented by the above method, so that wide range control of the cold cathode discharge tube can be achieved.

Further, in the present embodiment, we have described a driving device for a cold cathode discharge tube. However the same effects can be obtained by applying a similar method of driving a hot cathode discharge tube. In that case, it is needed to use a piezoelectric transformer of a step-down type.

Figures 7A, 7B:
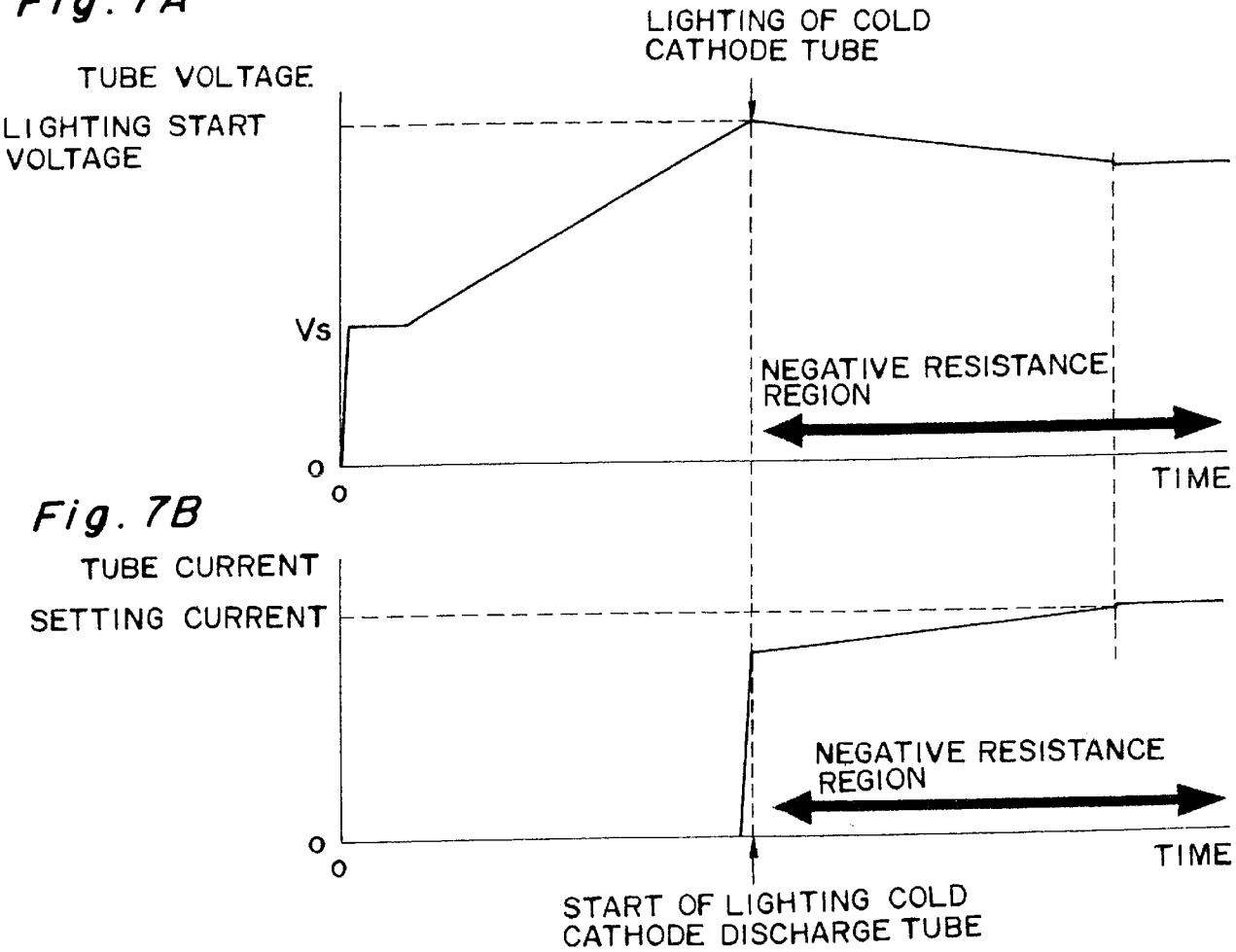
FIG. 7A is a graph showing temporal changes in a tube voltage in the case where tube voltage is controlled by varying stepwise (one step) before lighting starts.
FIG. 7B is a graph showing temporal changes in a tube current in the case where tube voltage is controlled by varying stepwise (one step) before lighting starts.
Figures 8A, 8B:
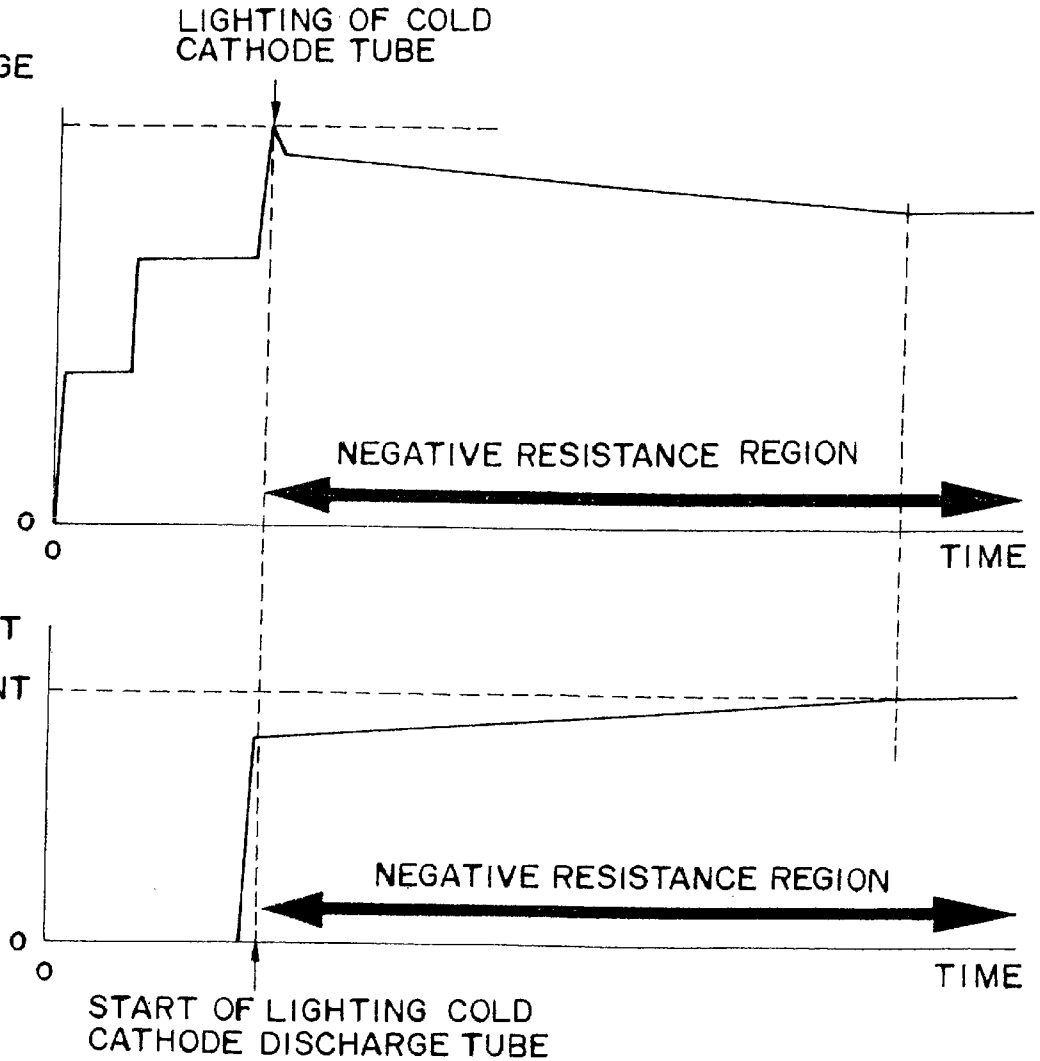
FIG. 8A is a graph showing temporal changes in a tube voltage in the case where tube voltage is controlled by varying stepwise (two steps) before lighting starts.
FIG. 8B is a graph showing temporal changes in a tube current in the case where tube voltage is controlled by varying stepwise (two steps) before lighting starts.

In the present embodiment, as shown in FIG. 6, the lighting of the discharge tube at low voltage has been performed by temporarily and continuously increasing the voltage (tube voltage) across the cold cathode discharge tube 210 from a low level. However, the tube voltage can be increased stepwise, as shown in FIG. 7. Specifically, the period for maintaining the tube voltage at a predetermined level may be provided before the start of the lighting. Specifically, the tube voltage can be linearly increased to a predetermined level Vs below the lighting start voltage Vb, maintained at that level Vs for a predetermined period, and increased again linearly. Similar effects can be obtained by this method. In this case, the voltage level first applied should be within the range in which Townsend discharge occurs and does not change into glow discharge. Further, there is an effect that the time until the lighting is started can be shortened. Further, the two or more periods in which tube voltage is maintained can be provided, and tube voltage can be varied at several steps. FIG. 8 illustrates the case where tube voltage is varied at two steps. In this case, by varying tube voltage stepwise, the projecting part occurs at the instance of lighting, but its magnitude can be made small, and the lighting start voltage can be reduced.

Second Embodiment

Figure 9:
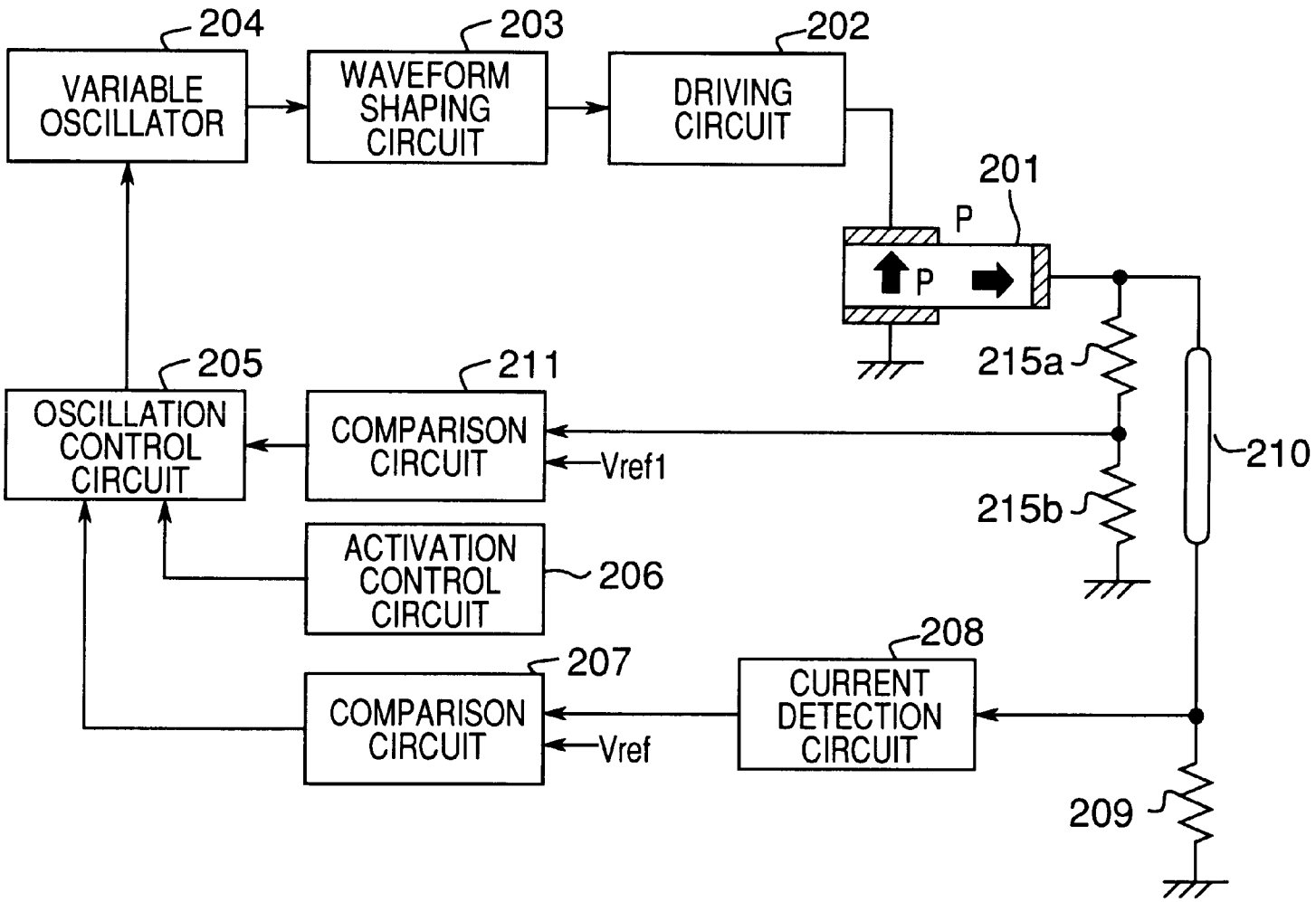
FIG. 9 is a block diagram of a driving device for a cold discharge tube in accordance with the second embodiment of the present invention.

FIG. 9 is a block diagram of a second embodiment of a driving device for a cold discharge tube in accordance with the present invention. The second embodiment differs from the first embodiment in that an over-voltage protection circuit for piezoelectric transformer 201 is provided. The over-voltage protection circuit comprises a comparison circuit 211 and resistors 215*a* and 215*b*.

As shown in FIG. 9, resistors 215*a* and 215*b* are connected to the secondary side of the piezoelectric transformer 201 in parallel to the cold cathode discharge tube 210 for the over-voltage protection. A voltage proportional to the voltage output from the secondary side of the piezoelectric transformer 201 is generated between the two ends of resistor 215*b*. The voltage across the resistor 215*b* is input to the comparison circuit 211. The comparison circuit 211 compares a voltage from the resistor 215*b* with a setting voltage Vref1. The setting voltage Vref1 is set at a reference voltage value by which it is determined that an over voltage has been applied to the piezoelectric transformer 201. If a voltage greater than the setting voltage Vref1 is input, the comparison circuit 211 outputs to the oscillation control circuit 205 a control signal that stops sweeping the driving frequency of the piezoelectric transformer 201.

In this way, by providing the over-voltage protection circuit for the piezoelectric transformer 201, it is possible to prevent a breakdown due to distortion when the cold cathode discharge tube 210 has not been lighted. Such distortion occurs when the cold cathode discharge tube 210 performs a large amplitude operation for driving at a neighborhood of its resonance frequency. The other control is performed in the same way as in the driving method described in the first embodiment.

By driving the piezoelectric transformer with the method described above, the breakdown of a piezoelectric transformer can be prevented at the start of lighting the cold cathode discharge tube. Therefore, a highly reliable inverter device of the piezoelectric transformer type can be provided.

Third Embodiment

Figure 10:
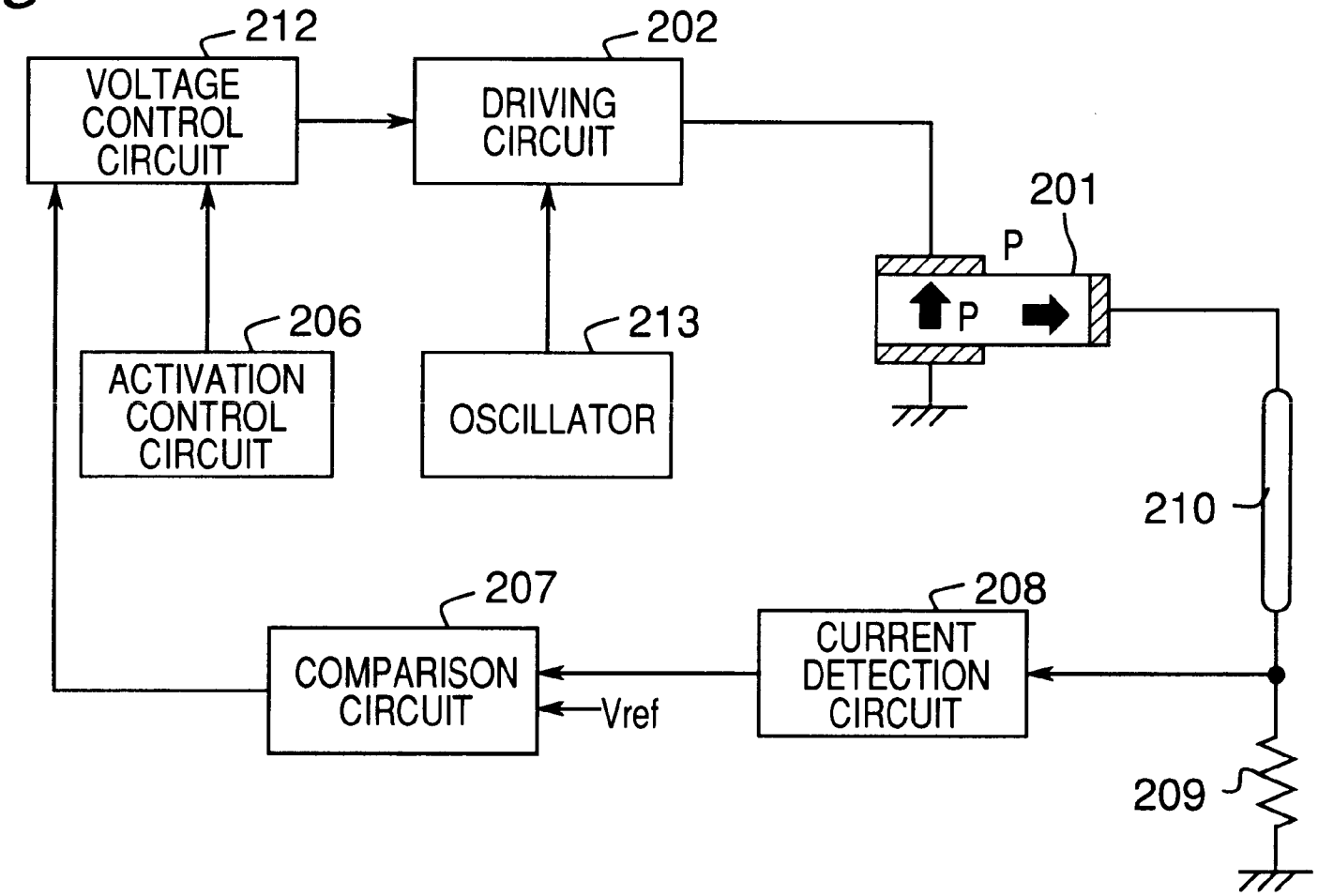
FIG. 10 is a block diagram of a driving device for a cold discharge tube in accordance with the third embodiment of the present invention.

FIG. 10 is a block diagram of a third embodiment of a driving device for a cold discharge tube in accordance with the present invention. The third embodiment differs from the first embodiment in that it has an oscillator 213 and a voltage control circuit 212 that controls the input voltage of the cold cathode discharge tube 210, in place of the waveform shaping circuit 203, the variable oscillator 204, and the oscillation control circuit 205, in order to drive the piezoelectric transformer 201 at a fixed frequency. The driving device of the present embodiment achieves the efficient driving of the piezoelectric transformer 201 by controlling a voltage at a fixed frequency fdrive near the resonance frequency of the piezoelectric transformer 201.

Figures 11A, 11B, 11C, 11D:
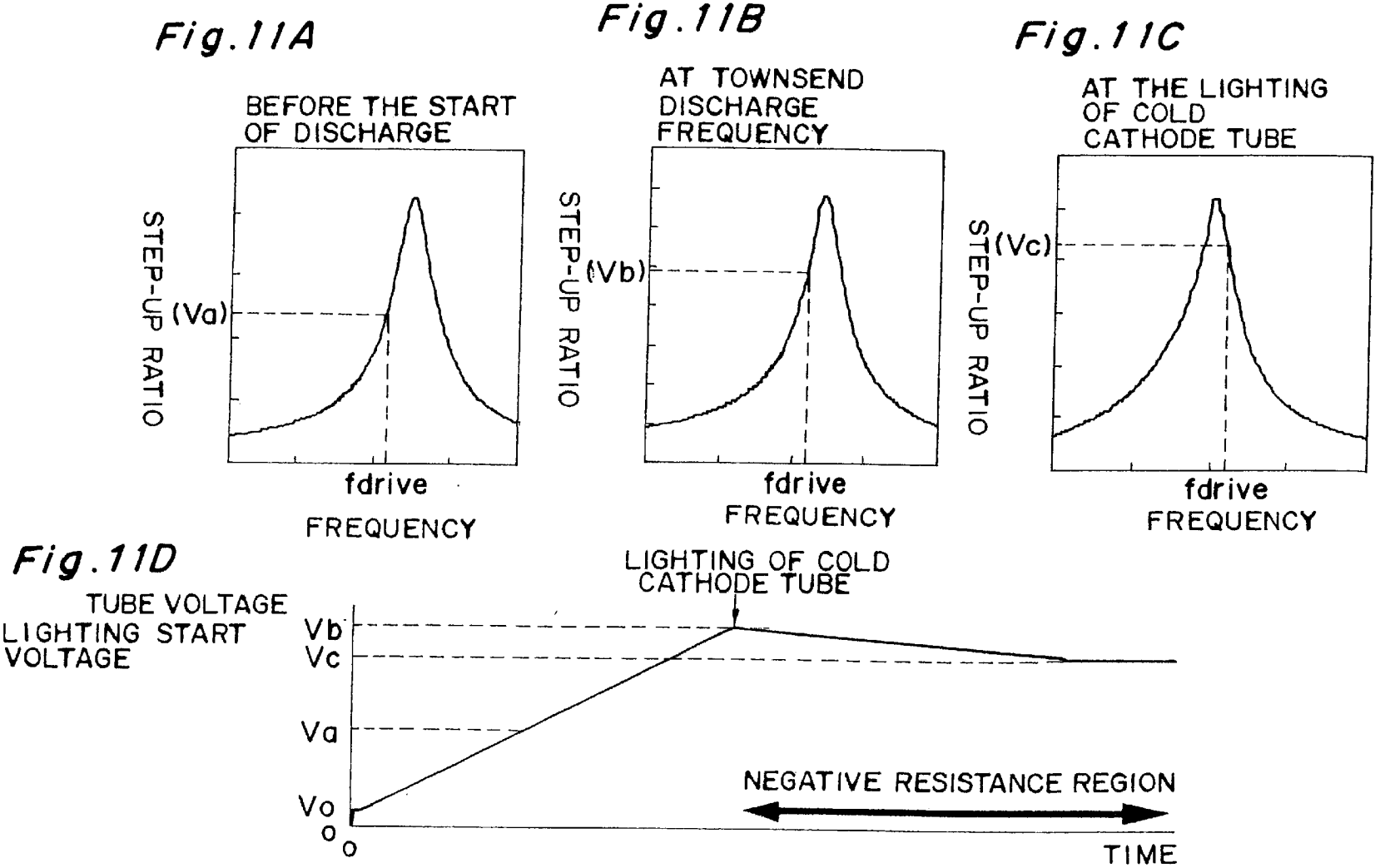
FIG. 11A is a graph showing a frequency characteristic of a piezoelectric transformer before the start of discharge.
FIG. 11B is a graph showing a frequency characteristic of the piezoelectric transformer at Townsend discharge.
FIG. 11C is a graph showing a frequency characteristic of the piezoelectric transformer when the cold cathode tube is lighted.
FIG. 11D is a graph showing temporal changes in a tube voltage in the case where a cold cathode discharge tube is driven by a driving device of the third embodiment.

FIG. 11A is a graph showing the frequency characteristics of the step-up rate of the piezoelectric transformer 201 before the start of discharge. FIG. 11B is a graph showing the frequency characteristics of the step-up rate of the piezoelectric transformer 201 during Townsend discharge of the cold cathode discharge tube 210. FIG. 11C is a graph showing the frequency characteristics of step-up rate of the piezoelectric transformer 201 while the cold cathode tube 210 is lighting. FIG. 11D is a graph showing temporal changes in tube voltage in the case where the cold cathode discharge tube is driven by a driving device of the third embodiment.

The driving method for a cold cathode discharge tube in the present embodiment includes fixing the driving frequency at a fixed frequency fdrive near the resonance frequency, and increasing gradually the input voltage of the piezoelectric transformer 201 so that the secondary side output of the piezoelectric transformer 201 can increase as shown in FIG. 1D. At this time, the secondary side output of the piezoelectric transformer 201 is increased at a speed slower than the rise speed of the cold cathode discharge tube 210 as in the first embodiment. Thus, the cold cathode discharge tube 210 can be lighted with a low lighting start voltage.

The lighting operation for the driving device of the present embodiment is described below.

In the driving device for a cold cathode discharge tube shown in FIG. 10, to light the cold cathode discharge tube 210, the activation control circuit 206 outputs a control signal to the voltage control circuit 212 so that the driving voltage for the piezoelectric transformer 201 can gradually rise from a voltage V0 lower than a voltage necessary to start lighting the cold cathode discharge tube 210 to the discharge starting voltage Vb. As a result, the piezoelectric transformer 201 outputs from its secondary side electrode a high voltage obtained by multiplying the voltage input from the primary side electrode by the step-up ratio corresponding to the fixed driving frequency fdrive. Further, the driving voltage is gradually increased while the frequency remains fixed. When the secondary side output voltage reaches Va, the cold cathode discharge tube 210 starts Townsend discharge. Until the lighting (glow discharge) of the cold cathode discharge tube 210 is started, an equivalent circuit for the cold cathode discharge tube 210 can be represented by variable capacitance. Therefore, a voltage is output from the piezoelectric transformer 201 following the curve PT2 (see FIG. 5) (In reality, the load changes with increases in the voltage, and thus the curve of the step-up ratio sequentially changes.). In this case, only a minute current is flowing in the feedback resistor 209, and the cold cathode discharge tube 210 is in a state of half-lighting. When the driving voltage is increased further, and the secondary side output of the piezoelectric transformer 201 reaches the lighting start voltage Vb of the cold cathode discharge tube 210, the cold cathode discharge tube 210 lights. Then, a current starts to flow through the feedback resistor 209, an operation of the activation control circuit 206 stops, and the voltage control circuit 212 is controlled by the output from the comparison circuit 207 so that the tube voltage can become a setting value.

When the cold cathode discharge tube 210 is in a lighting state, an equivalent circuit for cold cathode discharge tube 210 is represented by a parallel circuit comprising a resistor and a capacitor, and shows a negative resistance characteristic where a voltage decreases as a current increases.

Since the cold cathode discharge tube 210 has a negative resistance characteristic, the voltage across the cold cathode discharge tube 210 is going to decline as the output power of the secondary side of piezoelectric transformer 201 becomes greater. The current increases until it becomes a setting current, and then the tube voltage reaches Vc.

Figure 12:
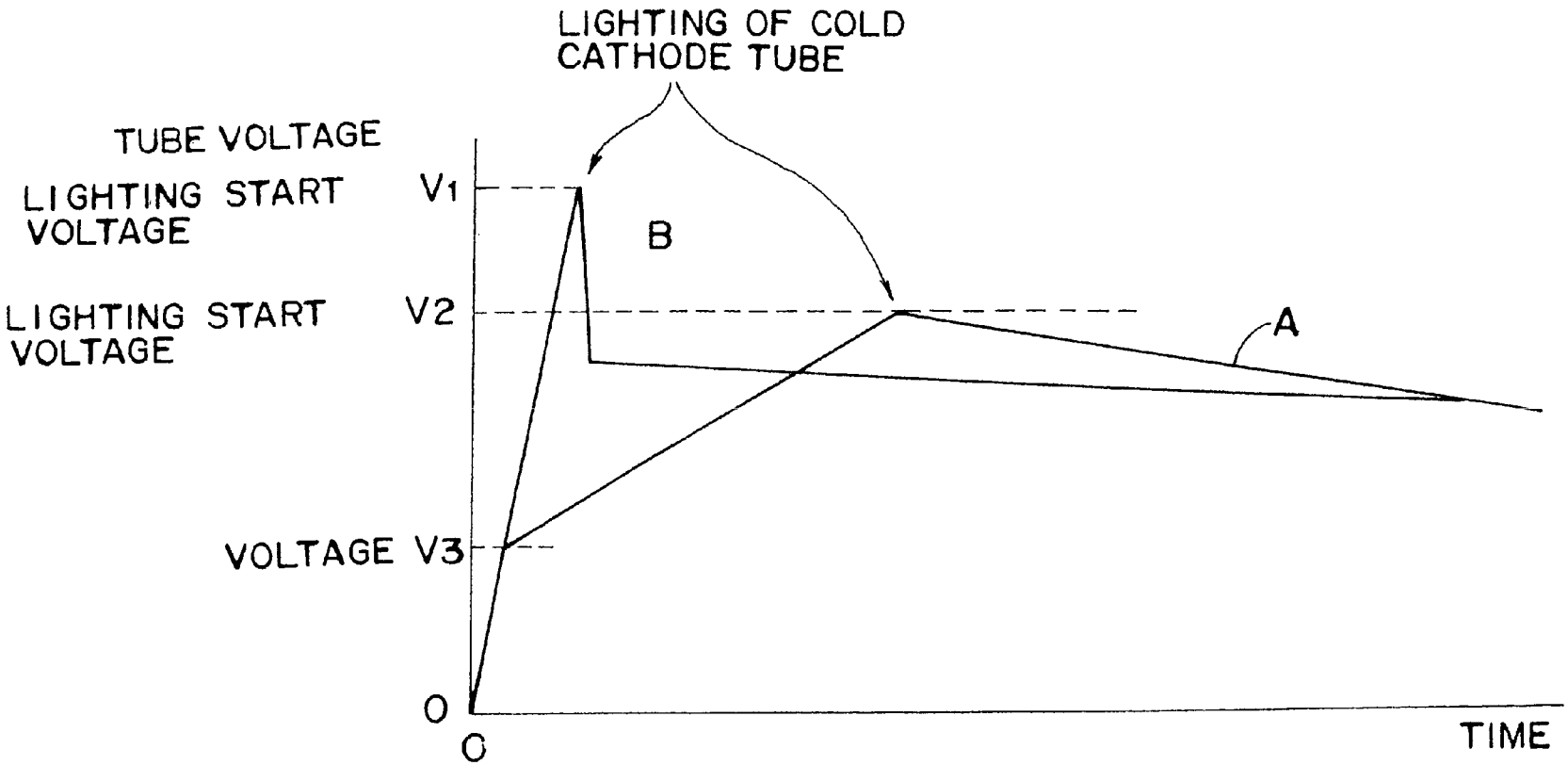
FIG. 12 is a graph where changes in driving voltage in a driving device for a cold cathode discharge tube in accordance with the present invention is compared with changes in driving voltage in a prior device.

FIG. 12 is a graph in which a temporal change (Curve A) in the tube voltage by the driving method of the present embodiment is compared with a temporal change (Curve B) in the tube voltage by the method of the prior art. As shown in the figure, the lighting start voltage V2 in the present embodiment is lower than the prior lighting start voltage V1. Specifically, when using the driving method of the present embodiment for a cathode discharge tube with a diameter of 3 mm and a length of 390 mm, the lighting start voltage in the peak-to-peak value was 3.5 kVpp. When using the prior lighting method, the lighting start voltage was 4.5 kVpp. Therefore, we could reduce the lighting start voltage by 1.0 kVpp.

In the present embodiment the lowering of lighting voltage for a discharge tube can be achieved by gradually increasing the voltage across the cold cathode discharge tube 210 from a low voltage level. However, as shown in FIG. 7, the tube voltage can be increased stepwise before lighting starts. That is, we can provide a period in which tube voltage is maintained. Specifically, as shown in FIG. 7, the tube voltage can be linearly increased to a predetermined level Vs below the lighting start voltage Vb, maintained at that level Vs for a predetermined time period, and increased again linearly. This method can provide similar effects. In this case, the voltage level first applied could be at a level at which Townsend discharge occurs but glow discharge does not occur, and the time until the lighting starts can be shortened. Further, two or more periods in which the tube voltage is maintained can be provided, and the tube voltage may be varied at several steps. For example, the tube voltage may be varied at two steps.

Adjustment of light for a cold cathode discharge tube has not been described in the present embodiment. If light is adjusted by repeating lighting and putting-out, the lighting time for the second or later lighting can be shorter than that for the first lighting. In the case of performing adjustment of light by lighting and putting out the cold cathode discharge tube, the dispersion of luminance during driving and a delay in lighting can be prevented by the above method, so that an effect of achieving wide-range control of the cold cathode discharge tube can be obtained.

Further, in the present embodiment, the description is made to a driving device for a cold cathode discharge tube, but similar effects can be obtained by applying a similar driving method to a hot cathode discharge tube as long as a piezoelectric transformer of a step-down type is used.

Fourth Embodiment

Figure 13:
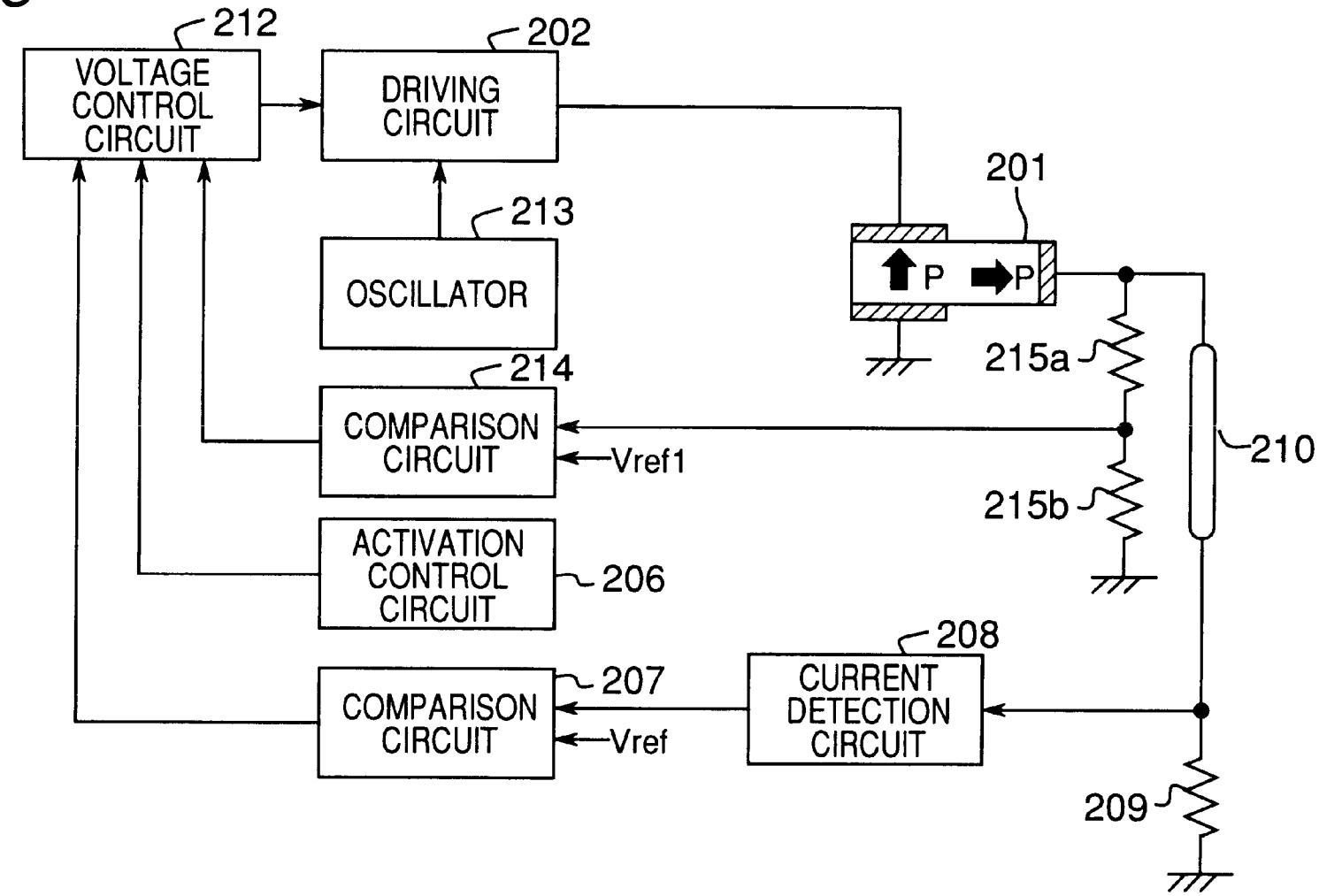
FIG. 13 is a block diagram of a driving device for a cold discharge tube in accordance with the fourth embodiment of the present invention.

FIG. 13 is a block diagram of a fourth embodiment of a driving device for a cold discharge tube. The fourth embodiment differs from the third embodiment in that an over-voltage protection circuit for the piezoelectric transformer 201 is provided. The over-voltage protection circuit composes a comparison circuit 214 and resistors 215*a* and 215*b* for dividing a voltage.

In order to protect the piezoelectric transformer 201 from over voltage, the resistors 215*a* and 215*b* are connected to the secondary side of the piezoelectric transformer 201 in parallel to the cold cathode discharge tube 210. A voltage proportional to the voltage output from the secondary side of piezoelectric transformer 201 is generated between the two ends of the resistor 215*b*. The voltage across the resistor 215*b* is input to the comparison circuit 214. The comparison circuit 214 compares the voltage from the resistor 215*b* with a setting voltage Vref1. The setting voltage Vref1 is set at a reference voltage value by which it is determined that an over voltage has been applied to the piezoelectric transformer 201. When a voltage greater than the setting voltage Vref1 is input, the comparison circuit 211 outputs a control signal to the voltage control circuit 212 to stop increasing the driving voltage for the piezoelectric transformer 201.

In this way, by providing the over-voltage protection circuit for the piezoelectric transformer 201, when the cold cathode discharge tube 210 does not light, a breakdown due to distortion occurred by a large amplitude operation induced by increasing driving voltage can be prevented. The other controls are performed in the same way as in the driving method described in the third embodiment.

By driving a piezoelectric transformer in this way, the breakdown of a piezoelectric transformer can be prevented during the start of lighting a cold cathode discharge tube. Therefore, a highly reliable inverter device of the piezoelectric transformer type can be provided.

Fifth Embodiment

A driving device in the present embodiment differs from one in the previous embodiment in that an electromagnetic transformer is used as a step-up transformer, and that controls during the start of lighting and during lighting are performed based on the control of the input voltage.

Figure 14:
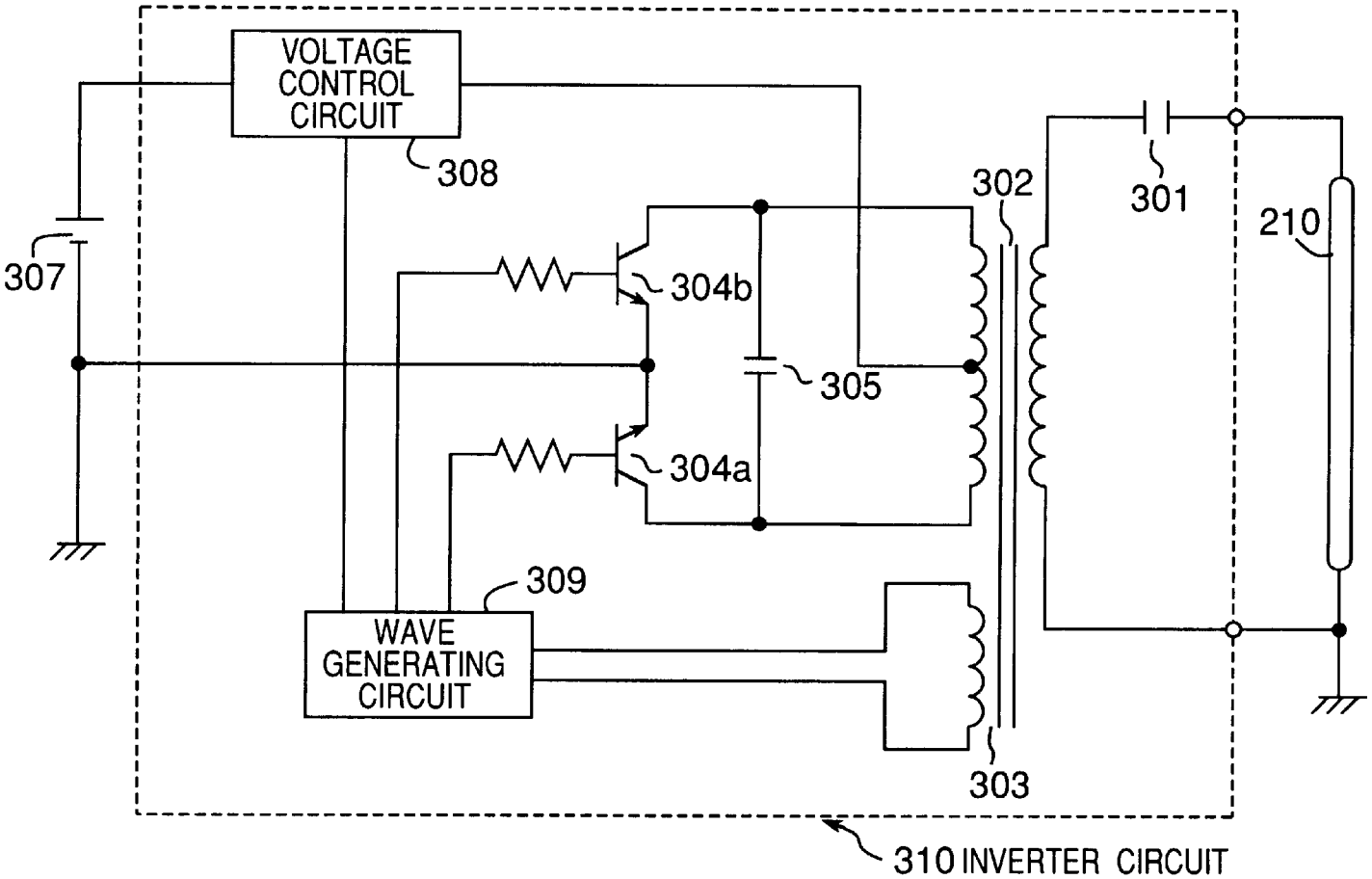
FIG. 14 is a block diagram of a driving device or a cold discharge tube in accordance with the fifth embodiment of the present invention.

FIG. 14 is a block diagram of a fifth embodiment of a driving device for a cold discharge tube in accordance with the present invention. The driving device in the present embodiment comprises an inverter circuit 310.

The inverter circuit 310 comprises switching elements 304*a* and 304*b* such as transistors, a step-up transformer 302 that transforms an input voltage into a high voltage, a waveform generating circuit 309 that generates frequencies for switching, and a voltage control circuit 308 that controls the input voltage. An AC voltage is generated from a DC voltage provided by a DC power supply 307 by alternately switching 304*a* and 304*b*. This AC voltage is a voltage transformed by the step-up transformer 302 into a high AC voltage and supplied to the cold cathode discharge tube 210.

The voltage control circuit 308 controls the voltage input to the step-up transformer 302 so that the voltage can slowly increase until the cold cathode discharge tube 210 is lighted. After the cold cathode discharge tube 210 is lighted, the voltage control circuit 308 controls the voltage so that the current flowing through the cold cathode discharge tube 210 can be constant.

In the step-up transformer 302 of the electromagnetic type, the ratio (step-up ratio) of a voltage output from the secondary side to that input to the primary side is determined by the ratio of the number of turns in the primary coil to that in the secondary coil.

The voltage control circuit 308 controls operations of the waveform generating circuit 310 and switching elements 304*a* and 304*b* so that the voltage across the cold cathode discharge tube 210 can increase as shown in FIGS. 6, 7 and 8. In the present embodiment as well as the aforementioned embodiment, the voltage applied to the cold cathode discharge tube 210 (i.e. the output of the step-up transformer 302) is increased so that the increase in the applied voltage can be slower than the rising of the cold cathode discharge tube 210.

In the detail operation of the voltage control circuit 308 is described below with reference to FIG. 6.

When the driving device for the cold cathode discharge tube 210 starts, the input voltage V0 is input to the step-up transformer 302. In the step-up transformer 302, a voltage that is stepped up depending on the ratio of the turns is output from the secondary side (at this time, Townsend discharge is not occurring in the cold cathode discharge tube 210). Then, the input voltage is gradually increased, and the cold cathode discharge tube 210 starts Townsend discharge when the tube voltage reaches a predetermined value Va. As the voltage is raised further, the cold cathode discharge tube 210 which has been in a state of half-lighting starts lighting at the voltage Vb. After that, the cold cathode discharge tube 210 shows a negative resistance characteristic. Therefore, as the input voltage is raised, the tube voltage decreases and the tube current increases. After that, the input voltage is controlled at a value so that the current flowing through the cold cathode discharge tube 210 can become a setting value for the cold cathode discharge tube 210.

In the present embodiment, the lighting of the discharge tube at low voltage is caused by temporarily and continuously increasing the voltage across the cold cathode discharge tube 210 from a low level. However, similar effects can be obtained by the tube voltage is increased stepwise, as shown in FIGS. 7 and 8. In this case, the voltage level first applied may be within a range in which Townsend discharge occurs and does not change to glow discharge. In this case, the time until the lighting is started can be shortened.

Also in the present embodiment, as in the second and fourth embodiments, there may be provided a protection circuit that detects the voltage across the cold cathode discharge tube 210 and controls the voltage applied to the cold cathode discharge tube 210 based on the detected voltage so that an over voltage should not be applied.

Regarding a light adjustment for the cold cathode discharge tube, in case that a light adjustment is performed by repeating lighting and putting-out the discharge tube at the start of lighting of the discharge tube, the lighting period for the second or later lighting may preferably be shorter than that for the first lighting. By using such an way to alternately light or put out the cold cathode discharge tube for light adjustment, the dispersion of luminance during driving and a delay in lighting can be prevented by the above method. Thus an effect of achieving wide-range control of the cold cathode discharge tube can be achieved.

Further, in the present embodiment, description is made to a driving device for a cold cathode discharge tube. However similar effects can be obtained by applying a similar method of driving a hot cathode discharge tube as long as an electromagnetic transformer of a step-down type is used.

Advantages of the Invention

As described above in detail, the driving device for a cathode discharge tube in accordance with the present invention more slowly increases the applied voltage than the rise speed of the cathode discharge tube. By this means, Townsend discharge is generated, and by gradually increasing its degree, the voltage for starting to light the cathode discharge tube can be lowered.

As a result, even if the cathode discharge tube used for a back-light of a liquid crystal display apparatus is elongated and the lighting start voltage becomes higher, the application of over voltage can be prevented during the start of lighting and a safe design of the circuit can be possible. Further, in case of an inverter used for back-light of a liquid crystal display apparatus, especially in an inverter of the piezoelectric transformer type, the amplitude of the piezoelectric transformer becomes higher to generate the higher voltage, as the lighting start voltage becomes higher. This large amplitude causes reliability to be deteriorated. However, the driving method according to the invention enable the lighting start voltage to be lowered and thus to reduce the burdens of the elements.

Further, regarding a hot cathode discharge tube mainly used with an electromagnetic transformer, the step-up transformer can be made compact by lowering the lighting start voltage.

In this way, according to a driving device of the present invention, a lighting device of high reliability and compact size can be provided.

Although the present invention has been described in connection with specified embodiments thereof, many other modifications, corrections and applications are apparent to those skilled in the art. Therefore, the present invention is not limited by the disclosure provided herein but limited only to the scope of the appended claims.

It is noted that this application is based on application No. 2000-356154 filed in Japan, the contents of which is herein incorporated by reference.

What is claimed is:

1. A driving apparatus for driving a cathode discharge tube by applying an AC voltage to the cathode discharge tube, comprising:

a voltage application section which outputs an AC voltage to be applied to the cathode discharge tube; and a voltage controller which controls the output of the voltage application section, wherein, in order to light the cathode discharge tube, the voltage controller controls the output of the voltage application section so that the AC voltage applied to the cathode discharge tube is raised at a speed slower than a rise speed of the cathode discharge tube.

2. The apparatus according to claim 1, wherein the voltage application section comprises an oscillator which outputs a voltage signal of a predetermined frequency, and a piezoelectric transformer which steps up the input voltage by using the piezoelectric effect according to predetermined frequency characteristics to output the stepped up voltage, and wherein, in order to light the cathode discharge tube, the voltage controller sweeps the frequency of the AC voltage applied to the cathode discharge tube from a high side to a low side, and controls the output frequency of the oscillator so that the output voltage of the piezoelectric transformer is raised at a speed slower than a rise speed of the cathode discharge tube.

3. The apparatus according to claim 2 further comprising an over-voltage protecting section which detects the output voltage of the piezoelectric transformer and controls the output voltage of the piezoelectric transformer based on the detected voltage so that the output voltage does not exceed a predetermined voltage.

4. The apparatus according to claim 2, wherein the voltage controller controls the output of the oscillator during the sweep of the output frequency of the oscillator so that the speed of sweeping the frequency is decreased as the output frequency approaches a resonance frequency of the piezoelectric transformer.

5. The apparatus according to claim 2, wherein the voltage controller controls the output of the oscillator so that the cathode discharge tube first starts Townsend discharge by the AC voltage, and then the frequency of the AC voltage applied to the cathode discharge tube is swept from a high side to a low side.

6. The apparatus according to claim 5, wherein the voltage controller controls the output of the oscillator so that the AC voltage is raised stepwise with one or more steps to make the cathode discharge tube start Townsend discharge.

7. The apparatus according to claim 1, wherein the voltage application section has a piezoelectric transformer which steps up the input voltage by using the piezoelectric effect to output the stepped up voltage, and the voltage controller controls the input voltage to the piezoelectric transformer so that the frequency of the input voltage of the piezoelectric transformer is fixed, and the output voltage of the piezoelectric transformer is raised at a speed slower than a rise speed of the cathode discharge tube.

8. The apparatus according to claim 7, wherein the voltage controller controls the input voltage to the piezoelectric transformer before the lighting of the cathode discharge tube so that the input voltage is raised stepwise with one or more steps to make the cathode discharge tube start Townsend discharge.

9. The apparatus according to claim 7 further comprising an over-voltage protecting section which detects the output voltage of the piezoelectric transformer and controls the output voltage of the piezoelectric transformer based on the detected voltage so that the output voltage does not exceed a predetermined voltage.

10. The apparatus according to claim 1, wherein the voltage application section comprises an electromagnetic transformer of which step-up ratio is determined by the ratio of the number of turns in the primary coil to the number of turns in the secondary coil.

11. The apparatus according to claim 10 further comprising an over-voltage protecting section which detects the output voltage of the electromagnetic transformer and controls the output voltage of the electromagnetic transformer based on the detected voltage so that the output voltage does not exceed a predetermined voltage.

12. A driving apparatus for driving a cathode discharge tube by applying an AC voltage to the cathode discharge tube, comprising:

a voltage application section which outputs an AC voltage to be applied to the cathode discharge tube; and a voltage controller which controls the output of the voltage application section, wherein, in order to light the cathode discharge tube, the voltage controller controls the output of the voltage application section so that the cathode discharge tube is half-lighted by the AC voltage, and subsequently the AC voltage is raised at a speed slower than a rise speed of the cathode discharge tube.

13. The apparatus according to claim 12, wherein in case that a light adjustment is done by repeating lighting and putting out the cathode discharge tube at the start of lighting, the voltage controller controls a period for lighting the cathode discharge tube during the light adjustment so that the period for second or later lighting is shorter than a period for the first lighting.

14. The apparatus according to claim 12, wherein the voltage application section comprises an electromagnetic transformer of which step-up ratio is determined by the ratio of the number of turns in the primary coil to the number of turns in the secondary coil.

15. The apparatus according to claim 14 further comprising an over-voltage protecting section which detects the output voltage of the electromagnetic transformer and controls the output voltage of the electromagnetic transformer based on the detected voltage so that the output voltage does not exceed a predetermined voltage.

16. A driving apparatus for driving a cathode discharge tube by applying an AC voltage to the cathode discharge tube, comprising:

a voltage application section which outputs an AC voltage to be applied to the cathode discharge tube; and a voltage controller which controls the output of the voltage application section, wherein, in order to light the cathode discharge tube, the voltage controller controls the output of the voltage application section so that the cathode discharge tube is half-lighted by the AC voltage, the state of half-lighting is maintained for a predetermined period, and then the AC voltage is raised to a voltage level at which the cathode discharge tube starts discharging.

17. The apparatus according to claim 16, wherein the voltage controller varies the AC voltage stepwise while the cathode discharge tube is half-lighting.

18. The apparatus according to claim 16, wherein in case that a light adjustment is done by repeating lighting and putting out the cathode discharge tube at the start of lighting, the voltage controller controls a period for lighting the cathode discharge tube during the light adjustment so that the period for second or later lighting is shorter than a period for the first lighting.

19. The apparatus according to claim 16, wherein the voltage application section comprises an electromagnetic transformer of which step-up ratio is determined by the ratio of the number of turns in the primary coil to the number of turns in the secondary coil.

20. The apparatus according to claim 19 further comprising an over-voltage protecting section which detects the output voltage of the electromagnetic transformer and controls the output voltage of the electromagnetic transformer based on the detected voltage so that the output voltage does not exceed a predetermined voltage.

21. A method of driving a cathode discharge tube by applying an AC voltage to the cathode discharge tube, comprising:

outputting an AC voltage to be applied to the cathode discharge tube; and controlling the output AC voltage, wherein, in order to light the cathode discharge tube, the controlling includes controlling the output AC voltage so that the AC voltage applied to the cathode discharge tube rises at a speed slower than a rise speed of the cathode discharge tube.

22. The method according to claim 21, wherein in case that the cathode discharge tube is driven by a piezoelectric transformer for stepping up the input voltage by using the piezoelectric effect according to predetermined frequency characteristics to output the stepped up voltage, in order to light the cathode discharge tube, the controlling includes sweeping the frequency of the AC voltage applied to the cathode discharge tube from a high side to a low side, and controlling the output voltage of the piezoelectric transformer so that the output voltage rises at a speed slower than a rise speed of the cathode discharge tube.

23. The method according to claim 22, wherein the speed of sweeping the frequency is decreased as the swept frequency approaches a resonance frequency of the piezoelectric transformer.

24. The method according to claim 22, further comprising first making the cathode discharge tube start Townsend discharge by the AC voltage, and then sweeping the frequency of the AC voltage applied to the cathode discharge tube from a high side to a low side.

25. The method according to claim 24, wherein the AC voltage is raised stepwise with one or more steps in order to make the cathode discharge tube start Townsend discharge.

26. The method according to claim 22 further comprising detecting the output voltage of the piezoelectric transformer, and controlling the output voltage of the piezoelectric transformer based on the detected voltage so that the output voltage does not exceed a predetermined voltage.

27. The method according to claim 21, wherein in case that the cathode discharge tube is driven by a piezoelectric transformer for stepping up input voltage by using the piezoelectric effect to output the stepped up voltage, the controlling includes controlling the input voltage to the piezoelectric transformer so that the frequency of the input voltage of the piezoelectric transformer is fixed, and that the output voltage of the piezoelectric transformer rises at a speed slower than a rise speed of the cathode discharge tube.

28. The method according to claim 27, wherein the controlling includes controlling the input voltage to the piezoelectric transformer before the lighting of the cathode discharge tube so that the input voltage rises stepwise with one or more steps to make the cathode discharge tube start Townsend discharge.

29. The method according to claim 27 further comprising detecting the output voltage of the piezoelectric transformer, and controlling the output voltage of the piezoelectric transformer based on the detected voltage so that the output voltage does not exceed a predetermined voltage.

30. The method according to claim 21, wherein the cathode discharge tube is driven by an electromagnetic transformer of which step-up ratio is determined by the ratio of the number of turns in the primary coil to the number of turns in the secondary coil.

31. The method according to claim 30 further comprising detecting the output voltage of the electromagnetic transformer, and controlling the output voltage of the electromagnetic transformer based on the detected voltage so that the output voltage does not exceed a predetermined voltage.

32. A method of driving a cathode discharge tube by applying an AC voltage to the cathode discharge tube, comprising:

outputting an AC voltage to be applied to the cathode discharge tube; and controlling the output AC voltage, wherein the controlling includes controlling the output AC voltage so that the cathode discharge tube is half-lighted by the AC voltage, and subsequently the AC voltage rises at a speed slower than a rise speed of the cathode discharge tube.

33. The method according to claim 32, wherein, in case that a light adjustment is done by repeating lighting and putting out the cathode discharge tube at the start of lighting, the controlling includes controlling a period for lighting the cathode discharge tube during the light adjustment so that the period for second or later lighting is shorter than a period for the first lighting.

34. The method according to claim 32, wherein the cathode discharge tube is driven by an electromagnetic transformer of which step-up ratio is determined by the ratio of the number of turns in the primary coil to the number of turns in the secondary coil.

35. The method according to claim 34 further comprising detecting the output voltage of the electromagnetic transformer, and controlling the output voltage of the electromagnetic transformer based on the detected voltage so that the output voltage does not exceed a predetermined voltage.

36. A method of driving a cathode discharge tube by applying an AC voltage to the cathode discharge tube, comprising:

outputting an AC voltage to be applied to the cathode discharge tube; and controlling the output AC voltage, wherein, in order to light the cathode discharge tube, the controlling includes controlling the output AC voltage so that the cathode discharge tube is half-lighted by the AC voltage, the state of half-lighting is maintained for a predetermined period, and then the AC voltage rises to a voltage level at which the cathode discharge tube starts discharging.

37. The method according to claim 36, wherein the controlling includes varying the AC voltage stepwise while the cathode discharge tube is half-lighting.

38. The method according to claim 36, wherein, in case that a light adjustment is done by repeating lighting and putting out the cathode discharge tube at the start of lighting, the controlling includes controlling a period for lighting the cathode discharge tube during the light adjustment so that the period for second or later lighting is shorter than a period for the first lighting.

39. The method according to claim 36, wherein the cathode discharge tube is driven by an electromagnetic transformer of which step-up ratio is determined by the ratio of the number of turns in the primary coil to the number of turns in the secondary coil.

40. The method according to claim 39 further comprising detecting the output voltage of the electromagnetic transformer, and controlling the output voltage of the electromagnetic transformer based on the detected voltage so that the output voltage does not exceed a predetermined voltage.

41. A driving apparatus for driving a cathode discharge tube by applying an AC voltage to the cathode discharge tube, comprising:

a voltage application section that outputs an AC voltage to be applied to the cathode discharge tube; and a voltage controller that controls the output of the voltage application section, wherein, in order to light the cathode discharge tube, the voltage controller controls the output of the voltage application section so that the AC voltage applied to the cathode discharge tube is raised slowly and thereby a protrusion in voltage change does not appear at a moment of lighting of the cathode discharge tube.

* * * * *